US008316507B2

(12) United States Patent
Hyun et al.

(10) Patent No.: US 8,316,507 B2
(45) Date of Patent: Nov. 27, 2012

(54) VACUUM CLEANER AND DUST SEPARATING APPARATUS THEREOF

(75) Inventors: Kie-Tak Hyun, Changwon (KR); Hae-Seock Yang, Changwon (KR); Kyeong-Seon Jeong, Changwon (KR); Chang-Hoon Lee, Changwon (KR); Seong-Koo Cho, Changwon (KR); Geun-Bae Hwang, Changwon (KR); Jin-Wook Seo, Changwon (KR); Heon-Pyeong Ji, Changwon (KR); Man-Tae Hwang, Changwon (KR); Young-Ho Kim, Changwon (KR); Hyo-Churl Shin, Changwon (KR); Jin-Hyouk Shin, Changwon (KR); Hoi-Kil Jeong, Changwon (KR); Moo-Hyun Ko, Changwon (KR)

(73) Assignee: LG Electronics Inc., Seoul (KR)

( * ) Notice: Subject to any disclaimer, the term of this patent is extended or adjusted under 35 U.S.C. 154(b) by 532 days.

(21) Appl. No.: 12/537,697

(22) Filed: Aug. 7, 2009

(65) Prior Publication Data

US 2009/0293224 A1 Dec. 3, 2009

Related U.S. Application Data

(63) Continuation of application No. PCT/KR2008/001458, filed on Mar. 14, 2008.

(30) Foreign Application Priority Data

| | | |
|---|---|---|
| Mar. 16, 2007 | (KR) | 10-2007-0026341 |
| Apr. 12, 2007 | (KR) | 10-2007-0036041 |
| Nov. 14, 2007 | (KR) | 10-2007-0116321 |
| Nov. 14, 2007 | (KR) | 10-2007-0116324 |
| Nov. 15, 2007 | (KR) | 10-2007-0116452 |
| Nov. 19, 2007 | (KR) | 10-2007-0117692 |
| Nov. 19, 2007 | (KR) | 10-2007-0117693 |

(51) Int. Cl.
*A47L 9/10* (2006.01)

(52) U.S. Cl. ..... 15/353; 15/347; 15/327.1

(58) Field of Classification Search ..... 15/352, 15/353, 327.1, 347; 55/339, 347, 348, 320, 55/322, 337, 344, 419

See application file for complete search history.

(56) References Cited

U.S. PATENT DOCUMENTS 447,333 A 3/1891 Kutsche (Continued)

FOREIGN PATENT DOCUMENTS

CN 1347294 A 5/2002

(Continued)

OTHER PUBLICATIONS

O'Doherty et al., The Use of Tangential Offtakes for Energy Savings in Process Industries, Journal of Process Mechanical Engineering, 1992, pp. 99-109, vol. 206.

*Primary Examiner* — Dung Van Nguyen

(74) *Attorney, Agent, or Firm* — Birch, Stewart, Kolach & Birch, LLP

(57) ABSTRACT

A dust separating apparatus for a vacuum cleaner is provided. The dust separating apparatus includes a cyclone configured to provide a plurality of cyclone airflows therein and a dust container provided separate from the cyclone. The cyclone includes a first air inlet configured to receive an airflow containing dust and a dust outlet configured to discharge dust separated by the plurality of cyclone airflows. The dust outlet is located in a central portion of the cyclone. The dust container is removably placeable into communication with the dust outlet to collect dust separated in the cyclone. A vacuum cleaner including the dust separating apparatus is also provided.

20 Claims, 42 Drawing Sheets

U.S. PATENT DOCUMENTS

| | | | | |
|---|---|---|---|---|
| 3,505,703 | A | 4/1970 | Miller et al. | |
| 3,744,220 | A | 7/1973 | Klein | |
| 6,332,239 | B1 | 12/2001 | Dubos et al. | |
| 6,350,292 | B1 | 2/2002 | Lee et al. | |
| 6,436,160 | B1 | 8/2002 | Stephens et al. | |
| 6,572,668 | B1 | 6/2003 | An et al. | |
| 6,613,129 | B2 | 9/2003 | Gen | |
| 6,679,930 | B1 | 1/2004 | An et al. | |
| 6,810,558 | B2 | 11/2004 | Lee | |
| 7,419,521 | B2 | 9/2008 | Oh et al. | |
| 7,479,173 | B2 | 1/2009 | Ivarsson et al. | |
| 7,488,362 | B2 | 2/2009 | Jeong et al. | |
| 7,534,279 | B2 | 5/2009 | Oh et al. | |
| 7,628,833 | B2 | 12/2009 | Oh | |
| 7,686,861 | B2 | 3/2010 | Oh | |
| 7,854,782 | B2 * | 12/2010 | Oh et al. | 55/429 |
| 2005/0050678 | A1 | 3/2005 | Oh et al. | |
| 2005/0138759 | A1 | 6/2005 | Park et al. | |
| 2005/0138763 | A1 | 6/2005 | Tanner et al. | |
| 2005/0229554 | A1 | 10/2005 | Oh et al. | |
| 2005/0252179 | A1 | 11/2005 | Oh et al. | |
| 2006/0075728 | A1 | 4/2006 | Oh et al. | |
| 2006/0101609 | A1 | 5/2006 | Oh et al. | |
| 2006/0107630 | A1 | 5/2006 | Ivarsson et al. | |
| 2006/0117725 | A1 | 6/2006 | Oh et al. | |
| 2006/0230720 | A1 | 10/2006 | Han et al. | |
| 2007/0011997 | A1 | 1/2007 | Han et al. | |
| 2007/0079585 | A1 | 4/2007 | Oh et al. | |
| 2007/0143953 | A1 * | 6/2007 | Hwang et al. | 15/353 |
| 2009/0056290 | A1 | 3/2009 | Oh et al. | |
| 2009/0293224 | A1 | 12/2009 | Hyun et al. | |
| 2010/0043170 | A1 | 2/2010 | Ni | |

FOREIGN PATENT DOCUMENTS

| | | | |
|---|---|---|---|
| CN | 1353591 | A | 6/2002 |
| DE | 39 36 078 | A1 | 5/1991 |
| DE | 199 20 237 | A1 | 5/2000 |
| DE | 10 2004 030 350 | A1 | 1/2006 |
| DE | 20 2006 016 366 | U1 | 3/2007 |
| EP | 0996355 | B1 | 8/2004 |
| EP | 1 547 509 | A2 | 6/2005 |
| GB | 2 360 719 | A | 10/2001 |
| GB | 2 417 916 | A | 3/2006 |
| JP | 52-138367 | | 11/1977 |
| JP | 2003-112082 | A | 4/2003 |
| JP | 2003-139094 | A | 5/2003 |
| JP | 2004-033661 | A | 2/2004 |
| JP | 2004-121622 | A | 4/2004 |
| JP | 2004-135700 | A | 5/2004 |
| JP | 2004-174206 | A | 6/2004 |
| JP | 2005-040257 | A | 2/2005 |
| JP | 2005-324002 | A | 11/2005 |
| JP | 2005-342334 | A | 12/2005 |
| JP | 2006-130119 | A | 5/2006 |
| KR | 2000-0056656 | A | 9/2000 |
| KR | 10-2002-0078798 | A | 10/2002 |
| KR | 10-2005-0100913 | A | 10/2005 |
| KR | 10-0549990 | B1 | 2/2006 |
| KR | 10-2006-0030255 | A | 4/2006 |
| KR | 10-2006-0061493 | A | 6/2006 |
| KR | 10-0611067 | B1 | 8/2006 |
| KR | 10-0623916 | B1 | 9/2006 |
| KR | 10-2006-0105390 | A | 10/2006 |
| KR | 10-0645376 | B1 | 11/2006 |
| RU | 2240716 | C2 | 2/2000 |
| RU | 2237424 | C2 | 10/2004 |
| RU | 2272555 | C1 | 3/2006 |
| RU | 2281683 | C2 | 8/2006 |
| RU | 2286079 | C2 | 10/2006 |
| RU | 2288628 | C1 | 12/2006 |
| RU | 2308870 | C2 | 10/2007 |
| WO | 00/49933 | A1 | 8/2000 |
| WO | 00/64321 | A1 | 11/2000 |
| WO | 00/74548 | A1 | 12/2000 |
| WO | 2006/026414 | A2 | 3/2006 |
| WO | 2006/125945 | A1 | 11/2006 |
| WO | WO 2007/120535 | A2 | 10/2007 |

* cited by examiner

VACUUM CLEANER AND DUST SEPARATING APPARATUS THEREOF

CROSS-REFERENCE TO RELATED APPLICATIONS

This application is a continuation of International Patent Application No. PCT/KR2008/001458, filed Mar. 14, 2008, which claims priority to Korean Application No. 10-2007-0026341, filed Mar. 16, 2007, Korean Application No. 10-2007-0036041, filed Apr. 12, 2007, Korean Application No. 10-2007-0116321, filed Nov. 14, 2007, Korean Application No. 10-2007-0116324, filed Nov. 14, 2007, Korean Application No. 10-2007-0116452, filed Nov. 15, 2007, Korean Application No. 10-2007-0117692, filed Nov. 19, 2007, and Korean Application No. 10-2007-0117693, filed Nov. 19, 2007, all of which are herein incorporated by reference in their entireties.

BACKGROUND OF THE INVENTION

1. Field of the Invention

The present invention relates generally to a vacuum cleaner and a dust separating apparatus thereof. More particularly, the present invention relates to a vacuum cleaner and a dust separating apparatus thereof having a removable dust container.

2. Description of Related Art

In general, a vacuum cleaner is an apparatus that uses suctioning force imparted by a suction motor installed in a main body to suction air including dust and filter the dust within the main body. Such vacuum cleaners can largely be divided into canister vacuum cleaners that have a suctioning nozzle provided separately from and connected with a main body, and upright vacuum cleaners that have a suctioning nozzle coupled to the main body.

A related art vacuum cleaner includes a vacuum cleaner main body, and a dust separator installed in the vacuum cleaner main body for separating dust from air. The dust separator is generally configured to separate dust using a cyclone principle. Because performance of these types of vacuum cleaners can be rated based on the fluctuating range of their dust separating performance, dust separators for vacuum cleaners have continuously been developed to provide improved dust separating performance.

Also, from a user's perspective, dust separators for vacuum cleaners that can be easily separated from the vacuum cleaner main body, and that enable dust to easily be emptied, are desired.

BRIEF SUMMARY OF THE INVENTION

An object of the present invention is to provide a dust separator of a vacuum cleaner with improved dust separating performance.

Another object of the present invention is to provide a dust separator of a vacuum cleaner having a dust container with a simplified configuration to allow a user to easily empty dust.

A further object of the present invention is to provide a dust separator of a vacuum cleaner that allows a user to use minimal exertion to handle a dust container.

According to one aspect of the present invention, a dust separating apparatus for a vacuum cleaner is provided. The dust separating apparatus includes a cyclone configured to provide a plurality of cyclone airflows therein and a dust container provided separate from the cyclone. The cyclone includes a first air inlet configured to receive an airflow containing dust and a dust outlet configured to discharge dust separated by the plurality of cyclone airflows. The dust outlet is located in a central portion of the cyclone. The dust container is removably placeable into communication with the dust outlet to collect dust separated in the cyclone.

In accordance with another aspect of the present invention, a vacuum cleaner is provided. The vacuum cleaner includes a vacuum cleaner main body, a cyclone provided in the vacuum cleaner main body, and a dust container provided separate from the cyclone. The cyclone includes a first air inlet configured to receive an airflow containing dust and a dust outlet configured to discharge dust separated by the plurality of cyclone airflows. The dust outlet is located in a central portion of the cyclone. The dust container is removably placeable into communication with the dust outlet to collect dust separated in the cyclone.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Below, detailed descriptions of exemplary embodiments of the present invention will be provided with reference to the drawings.

Figure 1:
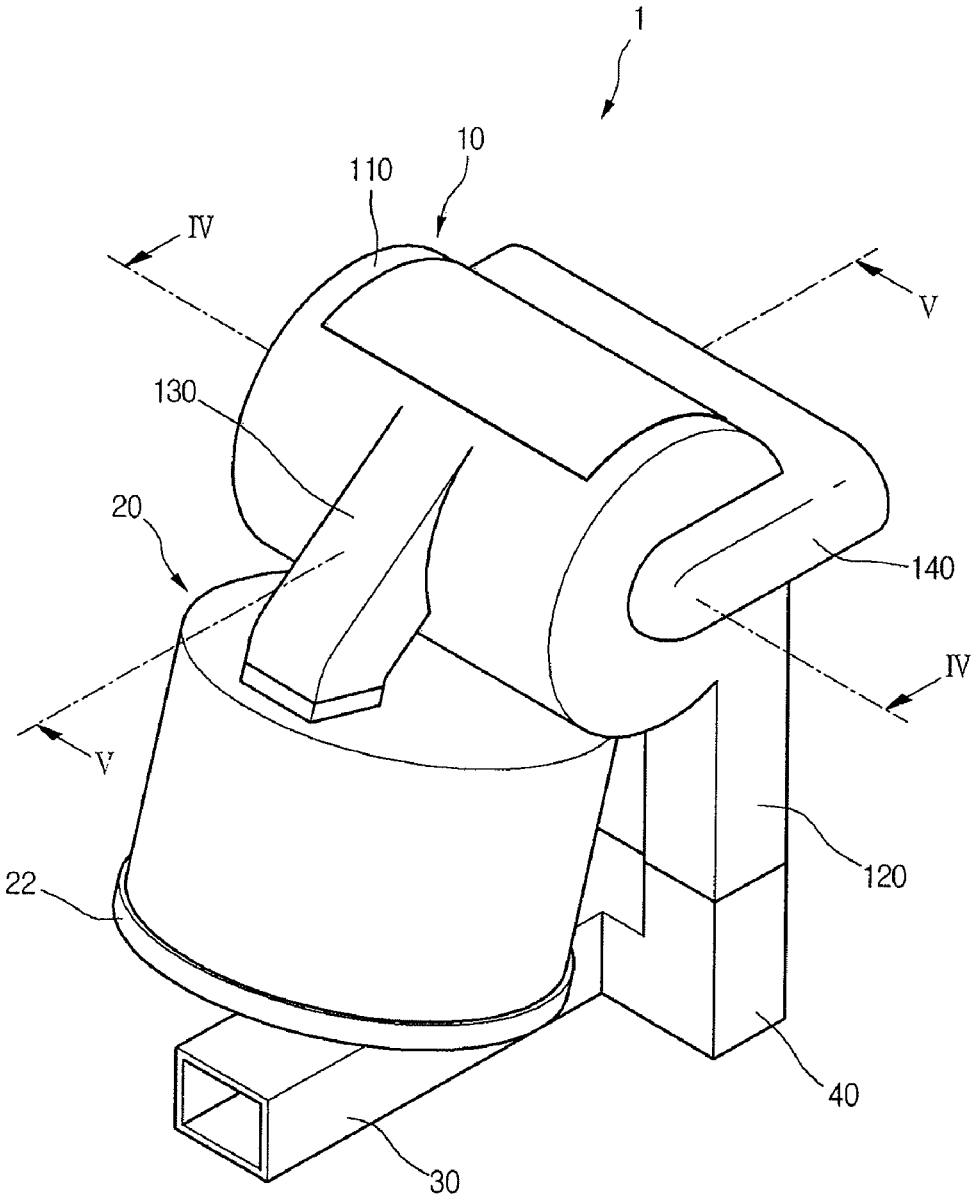
FIG. 1 is a front perspective view of a dust separating apparatus of a vacuum cleaner according to a first exemplary embodiment of the present invention.
Figure 2:
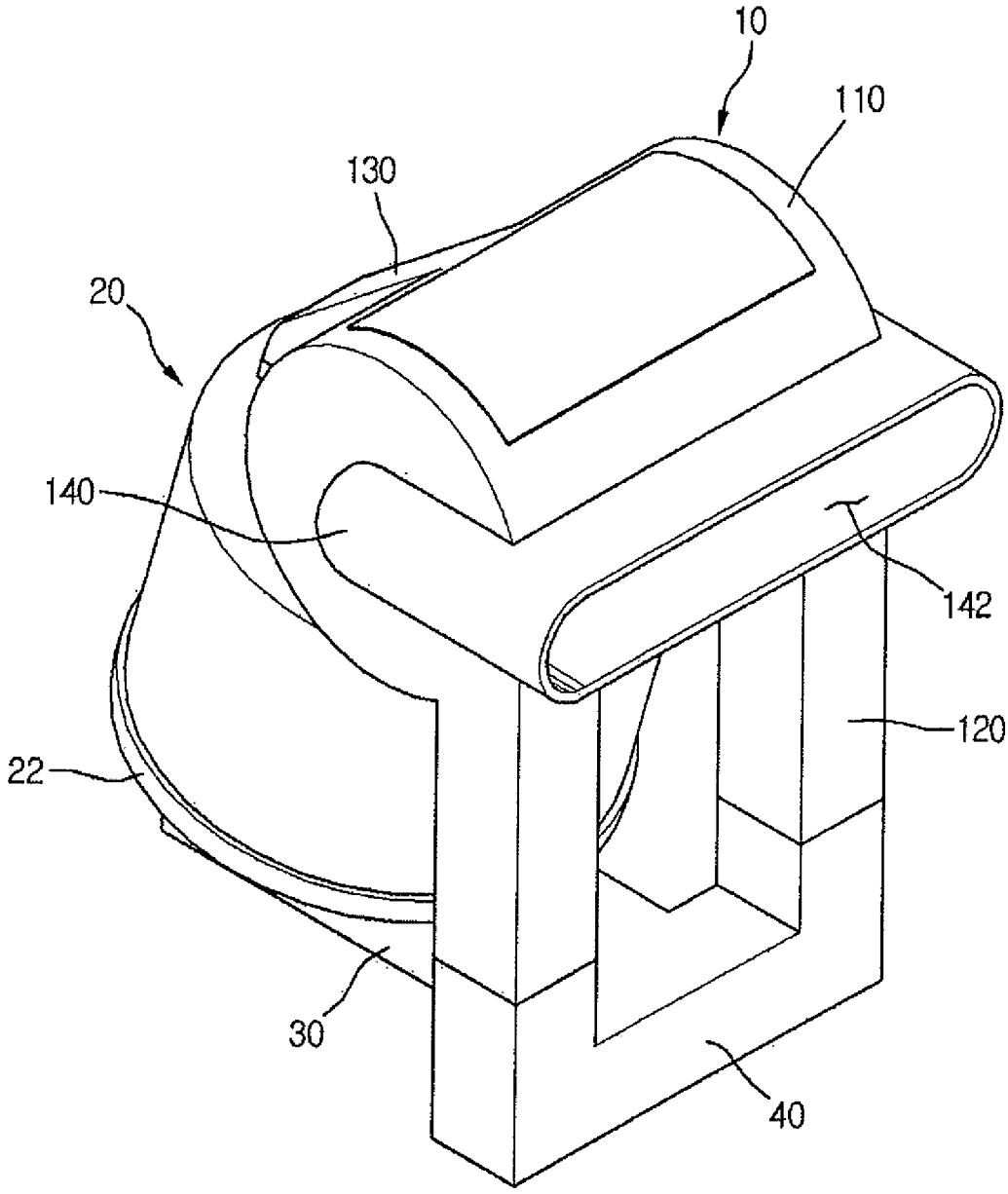
FIG. 2 is a rear perspective view of the dust separating apparatus of FIG. 1.
Figure 3:
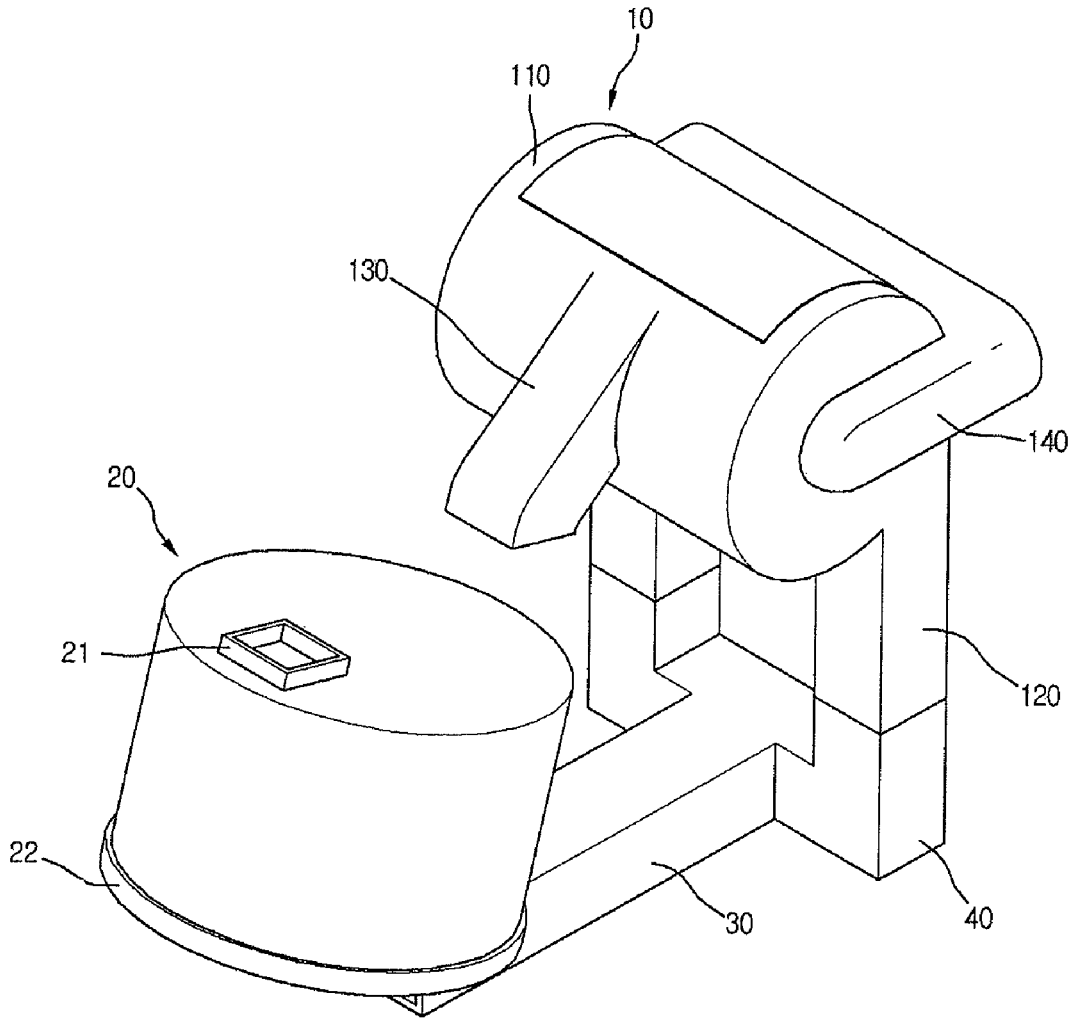
FIG. 3 is a disassembled perspective view of the dust separating apparatus of FIG. 1.

Referring to FIGS. 1 to 3, a dust separating apparatus 1 of a vacuum cleaner according to a first exemplary embodiment of the present invention includes a dust separating unit 10 that separates dust from suctioned air, a dust container 20 for storing dust separated by the dust separating unit 10, a suctioning guide 30 that guides the flow of air including dust toward the dust separating unit 10, and a distribution unit 40 for distributing the air in the suctioning guide 30 to the dust separating unit 10.

In particular, air suctioned through a suctioning nozzle (not shown) flows to the suctioning guide 30. The suctioning guide 30 is provided inside the vacuum cleaner, and is disposed below the dust container 20. The suctioning guide 30 has the distribution unit 40 connected thereto. The dust separating unit 10 separates dust from air supplied from the distribution unit 40. The dust separating unit 10 uses the cyclone principle to separate dust from air, and includes a cyclone 110 for this purpose. The axis of the cyclone 110 extends in a horizontal direction causing the air within the cyclone 110 to rotate about the horizontal axis.

A pair of air inlets 120 is formed (one on either side) at the cyclone 110 and are arranged to suction air. The pair of air inlets 120 may be formed in tangential directions with respect to the cyclone 110 in order to generate cyclone airflows within the cyclone 110. The pair of air inlets 120 provides suctioning passages for air entering the cyclone 110. Each air inlet 120 is connected at opposite sides of the distribution unit 40. Therefore, the air that flows through the suctioning guide 30 is branched at either side at the distribution unit 40, and the branched air rises along the respective air inlets 120 to be suctioned into the cyclone 110.

A dust outlet 130 that exhausts dust separated within the cyclone 110 is formed at the center of the cyclone 110. Accordingly, the dust contained within the air suctioned through each air inlet 120 at either side of the cyclone 110 is separated from the air by means of the cyclone airflows and moves to the center of the cyclone 110. Next, the dust that flows to the center of the cyclone 110 passes through the dust outlet 130 and is discharged to the dust container 20. In this first exemplary embodiment, the dust outlet 130 is formed tangentially with respect to the cyclone 110 to allow easy discharging of dust. Thus, the dust separated in the cyclone 110 is discharged tangentially with respect to the cyclone 110—that is, in the same direction in which the dust has been rotating—allowing easy discharging of not only dust with higher density, but also easy discharging of dust with lower density from the cyclone 110. Because dust with lower density can easily be discharged, less dust with lower density will accumulate on a filter member (to be described below), thereby facilitating flow of air and improving dust separating performance.

Also, air outlets 140 are formed on opposite sides of the cyclone 110 and are configured to discharge air separated from dust in the cyclone 110. The air discharged through the air outlets 140 converges at a converging passage 142 and enters the main body of the vacuum cleaner.

The dust container 20 stores dust separated in the dust separating unit 10. Because the dust container 20 is installed on the vacuum cleaner main body, the dust container 20 communicates with the dust separating unit 10. Specifically, when the dust container 20 is installed on the vacuum cleaner main body, the dust container 20 is disposed below the dust separating unit 10. Thus, a dust inlet 21 is formed in the upper surface of the dust container 20. Also, the dust outlet 130 extends downward from the cyclone 110 toward the dust inlet 21. Accordingly, the dust separated in the cyclone 110 moves downward along the dust outlet 130, and the separated dust can easily enter the dust container 20.

A cover member 22 is coupled at the bottom of the dust container 20 to discharge dust stored within. The cover member 22 may be pivotably coupled to the dust container 20, and may be detachably coupled thereto, as well. The coupling method of the cover member 22 in the first exemplary embodiment is not restricted to any particular methods. Thus, the dust container 20 is provided as a separate component to the dust separating unit 10, and is configured to be selectively communicable with the dust separating unit 10. Accordingly, a user can separate only the dust container 20 from the vacuum cleaner main body to empty dust stored in the dust container 20.

Because a structure for separating dust is not provided within the dust container 20 the structure of the dust container 20 is simplified and the weight of the dust container 20 can be minimized. By minimizing the weight of the dust container 20, a user can easily carry and handle the dust container 20, and because the internal structure of the dust container 20 is simple, dust can easily be emptied, and a user can easily clean the inside of the dust container 20.

Figure 4:
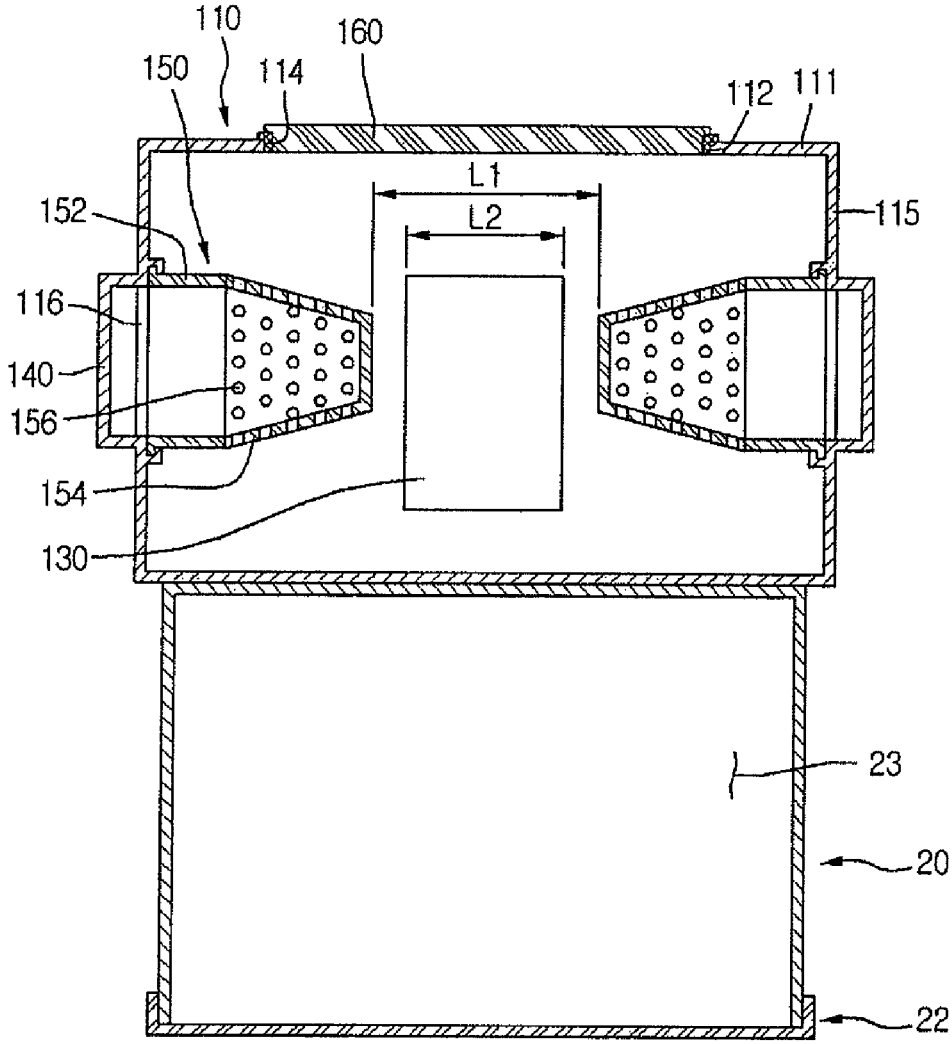
FIG. 4 is a sectional view taken along line IV-IV of FIG. 1.
Figure 5:
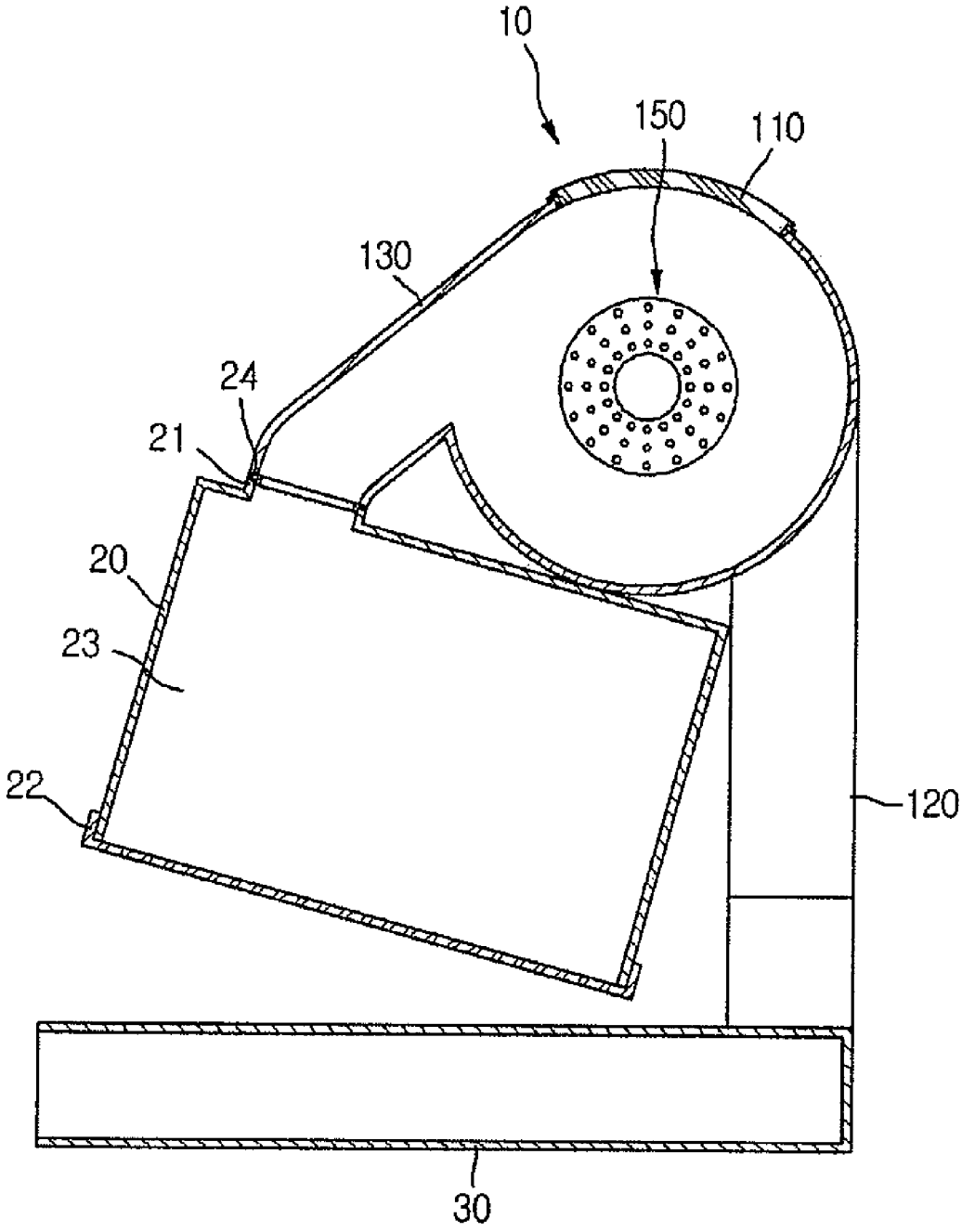
FIG. 5 is a sectional view taken along line V-V of FIG. 1.

Having described the dust separating apparatus 1 according to the first exemplary embodiment generally, a more specific description is provided with reference to FIGS. 4 and 5. Referring to FIGS. 4 and 5, the cyclone 110 includes a body 111 for generating cyclone airflow, and a pair of sides 115, each constituting opposite sides of the body 111. The sides 115 extend parallel to one another.

An air inlet 120 is formed on opposite sides of the body 111, respectively. Each air inlet 120 is formed tangentially with respect to the cyclone 110. Thus, the air suctioned through each air inlet 120 forms one of two cyclone airflows within the cyclone 110 and the cyclone airflows circulate along the inner surface of the body 111. Thus, when a pair of cyclone airflows is generated within a single space, the flow volume of air is increased, loss of airflow is reduced, separating performance can be improved, and the cyclone can be formed smaller than with a single cyclone airflow generated in a single space.

In this first exemplary embodiment, even if the cyclone 110 is formed smaller than in the related art, the centrifugal force generated at the air inlets 120 is greater than in the related art, thus improving dust separating performance. Also, when a pair of cyclone airflows is generated in a single space, the same level of dust separating performance as in a structure where air passes through a plurality of dust separating units can be realized. Thus, additional dust separating units for separating dust from air discharged from the dust separating unit are not required. However, additional dust separating units incorporating features of this first exemplary embodiment may be provided.

Furthermore, when a pair of cyclone airflows is generated with one at either side of the cyclone 110 and the cyclone airflows flow toward the center, the cyclone airflow at the center increases. Therefore, a stronger cyclone airflow is generated at the center of the cyclone 110 than at the sides of the air inlets 120. As a result, when the pair of cyclone airflows converges at the center of the cyclone 110, the strength of the airflow is greater than in the case where a single cyclone airflow is generated in a single space, thereby increasing dust separating performance.

Dust that moves to the center of the cyclone 110 can be discharged through the dust outlet 130 to the dust container 20 by means of the strong cyclone airflow, so that dust discharging performance can be increased. In addition, hair and other impurities that normally would adhere to the entrance or the inside of the dust outlet 130 because of static electricity do not adhere to the dust outlet 130 and are easily discharged to the dust container 20 because of the strong cyclone airflow generated at the dust outlet 130.

An outlet 116 is formed to pass through each side 115 to discharge air from which dust is separated in the cyclone 110. Also, a filter member 150 is coupled to each outlet 116 to filter the discharged air. In particular, the filter member 150 is configured with a cylindrical fastener 152 fastened to the inside of the cyclone 110, and a conical filter 154 extending from the fastener 152 to filter air. Also, a plurality of holes 156 is formed in the filter 154 for air to pass through. Accordingly, air separated from dust in the cyclone 110 passes through the plurality of holes 156 and is discharged from the cyclone 110 through the outlets 116.

In this first exemplary embodiment, the fastener 152 does not have through-holes formed therein so that air suctioned through the air inlet 120 is not immediately discharged, but is able to smoothly circulate within the cyclone 110. That is, because of the fasteners 152, the circulation of suctioned air can be guided to generate a smooth cyclone airflow within the cyclone 110, thereby increasing dust separating performance.

As seen in FIG. 4, a length (L1) between the pair of filter members 150 provided within the cyclone may be made greater than a width (L2) of the dust outlet 130. In this first exemplary embodiment, when the length (L1) between the pair of filter members 150 is made smaller than the width (L2) of the dust outlet 130, impurities such as hair and tissue paper are not discharged through the dust outlet 130, and can adhere to the filter member 150 or lodge inside the holes 156. As a result, the air cannot easily pass through the filter member 150, causing a reduction in suctioning force. Accordingly, the length (L1) between the pair of filter members 150 is made greater than the width (L2) of the dust outlet 130 so that impurities such as hair and tissue paper can be completely discharged through the dust outlet 130.

As described above in this first exemplary embodiment, air is suctioned through the plurality of air inlets 120 into the cyclone 110, and air separated from dust in the cyclone 110 is discharged from the cyclone 110 through the plurality of outlets 116. Thus, air that is suctioned into the cyclone 110 through the respective air inlets 120 is discharged through the respective outlets 116 to allow easy discharging of air. When air is thus easily discharged from the cyclone 110, suctioning force is increased, and cyclone airflow within the cyclone 110 is smoothly performed. Also, even when dust collects on one of the filter members 150 so that air cannot flow easily therethrough, air can be discharged through the other filter member 150, thereby preventing a sudden loss of air suctioning force.

An opening 112 is formed on the body 111 of the cyclone 110 to allow replacing and cleaning of the filter member 150. The opening 112 is opened and closed by means of a cover member 160. A sealing member 114 is provided at the coupling region of the opening 112 and the cover member 160. In this first exemplary embodiment, the inner surface of the cover member 160 may be formed to have the same curvature as the inner periphery of the body 111 when the cover member 160 is coupled to the body 111. That is, the inner peripheries of the cover member 160 and the body 111 form a continuous surface. Accordingly, changes to the cyclone airflow due to the cover member 160 within the cyclone 110 can be prevented, and the cyclone airflow can be uniformly maintained. Also, because the cover member 160 is detachably coupled to the cyclone 110, a user can detach the cover member 160 to easily replace the filter members 150 and easily clean the inside of the cyclone 110 and the filter members 150.

A dust compartment 23 for storing dust is defined within the dust container 20, and a dust inlet 21 is defined in the top of the dust container 20. Also, a sealing member 24, for sealing the contacting region between the dust inlet 21 and the dust outlet 130, is provided on the dust inlet 21. Here, the sealing member 24 may be provided on the dust outlet 130.

Figure 6:
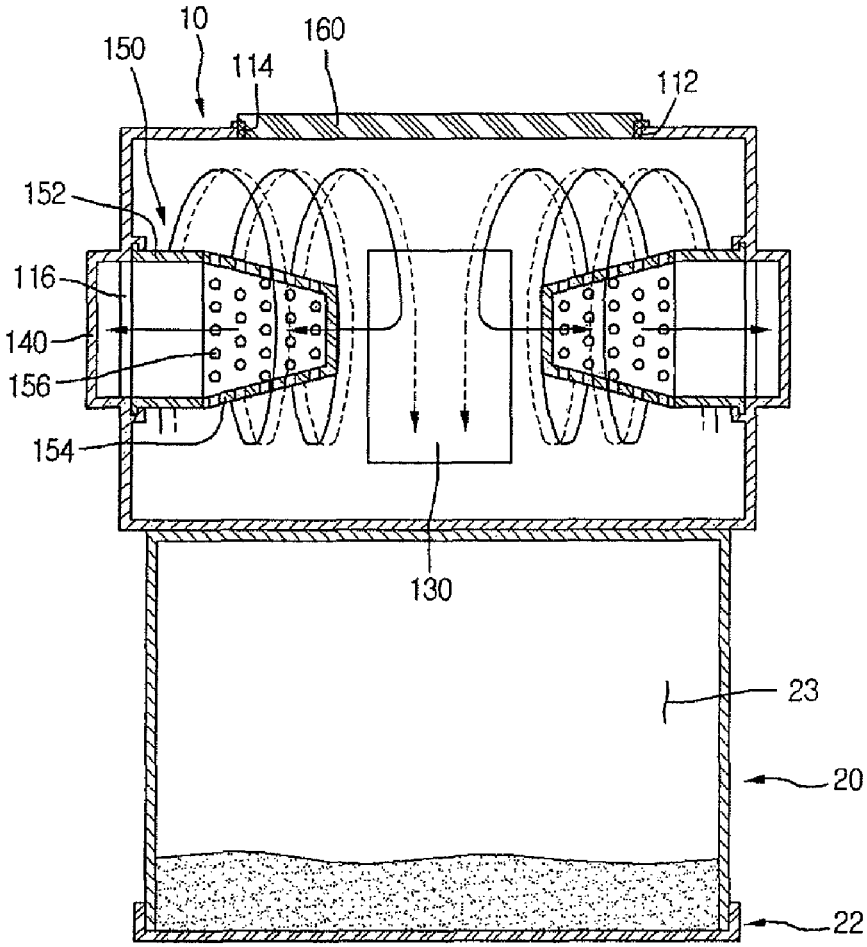
FIG. 6 is a schematic view similar to FIG. 4 showing airflow within the dust separating apparatus of FIG. 1.
Figure 7:
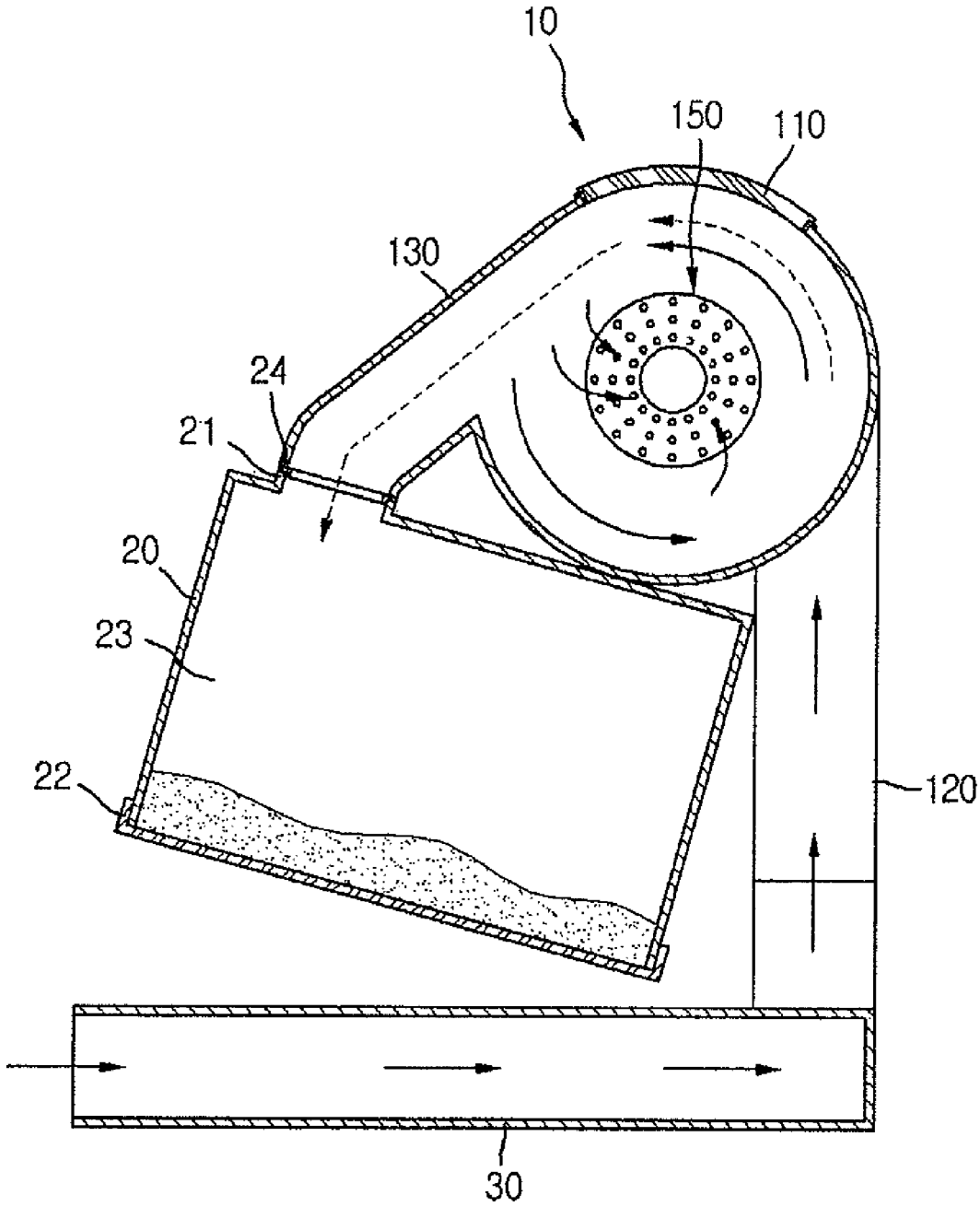
FIG. 7 is a schematic view similar to FIG. 5 showing airflow within the dust separating apparatus of FIG. 1.

The operation of the dust separating apparatus 1 will be described with reference to FIGS. 6 and 7. When suctioning force is generated by the vacuum cleaner, air including dust flows along the suctioning guide 30. The air flowing through the suctioning guide 30 flows to the distribution unit 40 and is distributed to each air inlet 120 by the distribution unit 40. Then, the air, including dust, passes through each air inlet 120 and is suctioned in tangential directions at either side of the cyclone 110.

The suctioned air rotates along the inner surface of the cyclone 110 to move toward and converge at the center of the cyclone 110. During this process, air and dust are subjected to different centrifugal forces due to their differences in weight, so that dust is separated from the air. The separated dust (represented by the broken lines) is discharged from the center of the cyclone 110 through the dust outlet 130, and the discharged dust flows through the dust outlets 130 and into the dust container 20. Conversely, air (represented by the solid lines) separated from dust is filtered by the filter members 150, and then passes through the outlets 116 and is discharged from the cyclone 110. The discharged air flows through the respective air outlets 140, converges at the converging passage 142, and enters the main body of the vacuum cleaner.

Having described a dust separator for a vacuum cleaner according to a first exemplary embodiment above, a dust separator for a vacuum cleaner according to a second exemplary embodiment will be described with reference to FIGS. 8-11. The second exemplary embodiment is the same as the first exemplary embodiment in all other aspects except for the structure of the air passage within the dust separating unit. Therefore, description will be provided of only the distinguishing portions of the second exemplary embodiment, and the description of portions that are the same as in the first exemplary embodiment will be omitted.

Figure 8:
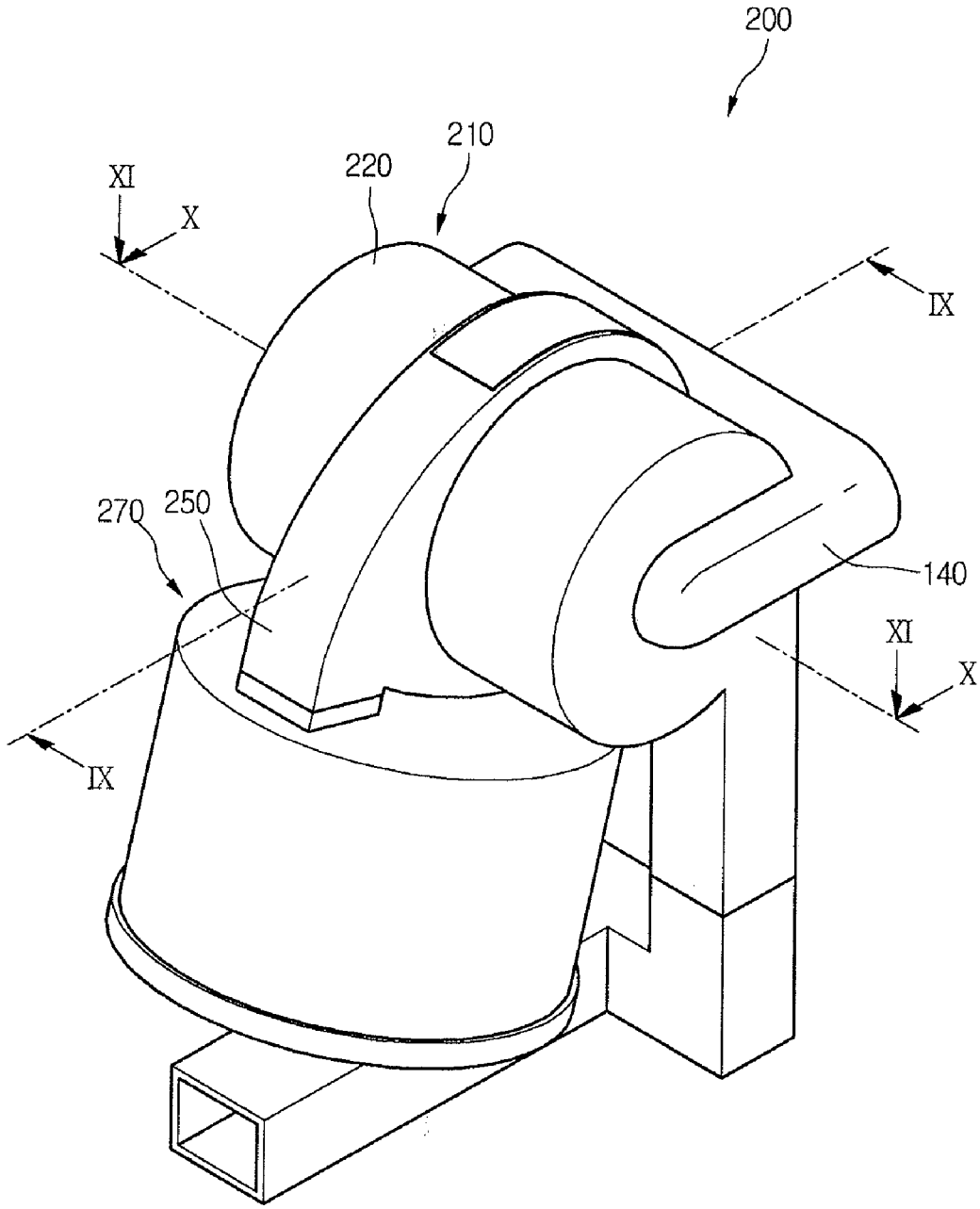
FIG. 8 is a sectional view showing the structure of a dust separating unit according to a second exemplary embodiment of the present invention.

Referring to FIG. 8, a dust separating apparatus 200 according to the present exemplary embodiment includes a dust separating unit 210, and a dust container 270 provided at the outside of the dust separating unit 210 to store dust separated in the dust separating unit 210. The dust separating unit 210 includes a cyclone 220 for generating cyclone airflow. The diameter at the center of the cyclone 220 is formed larger than the diameter at either side of the cyclone 220. A dust outlet 250 is formed at the center of the cyclone 220 to discharge dust separated in the cyclone 220 to the dust container 270.

Figure 9:
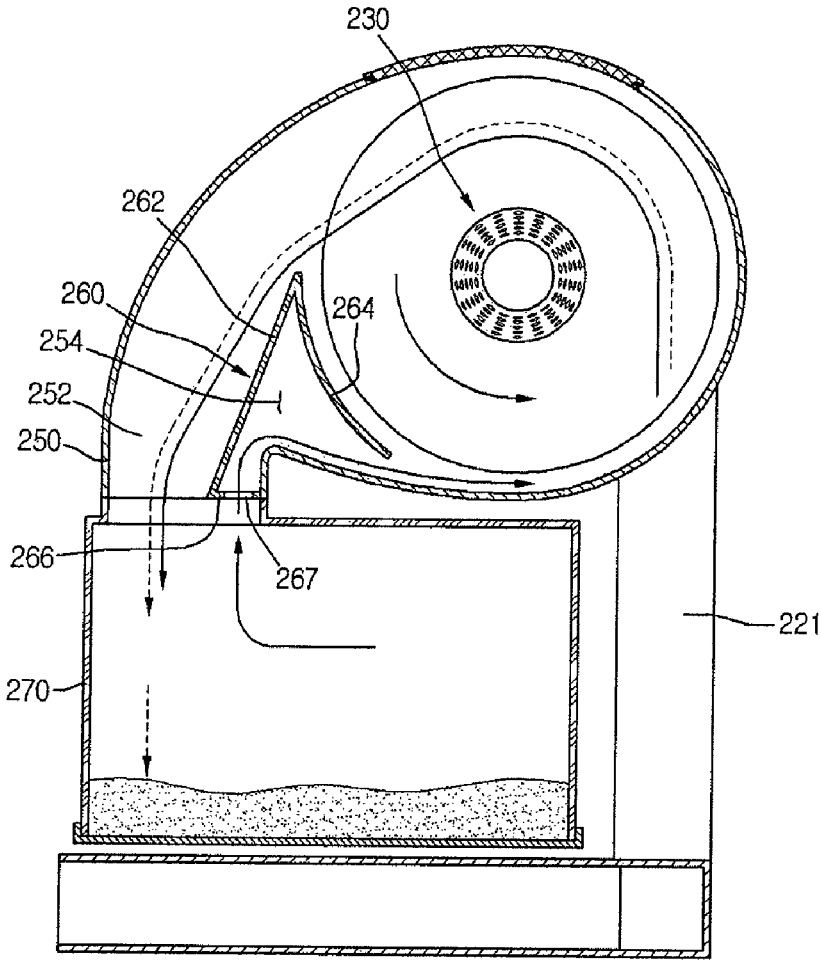
FIG. 9 is a sectional view taken along line IX-IX of FIG. 8.
Figure 10:
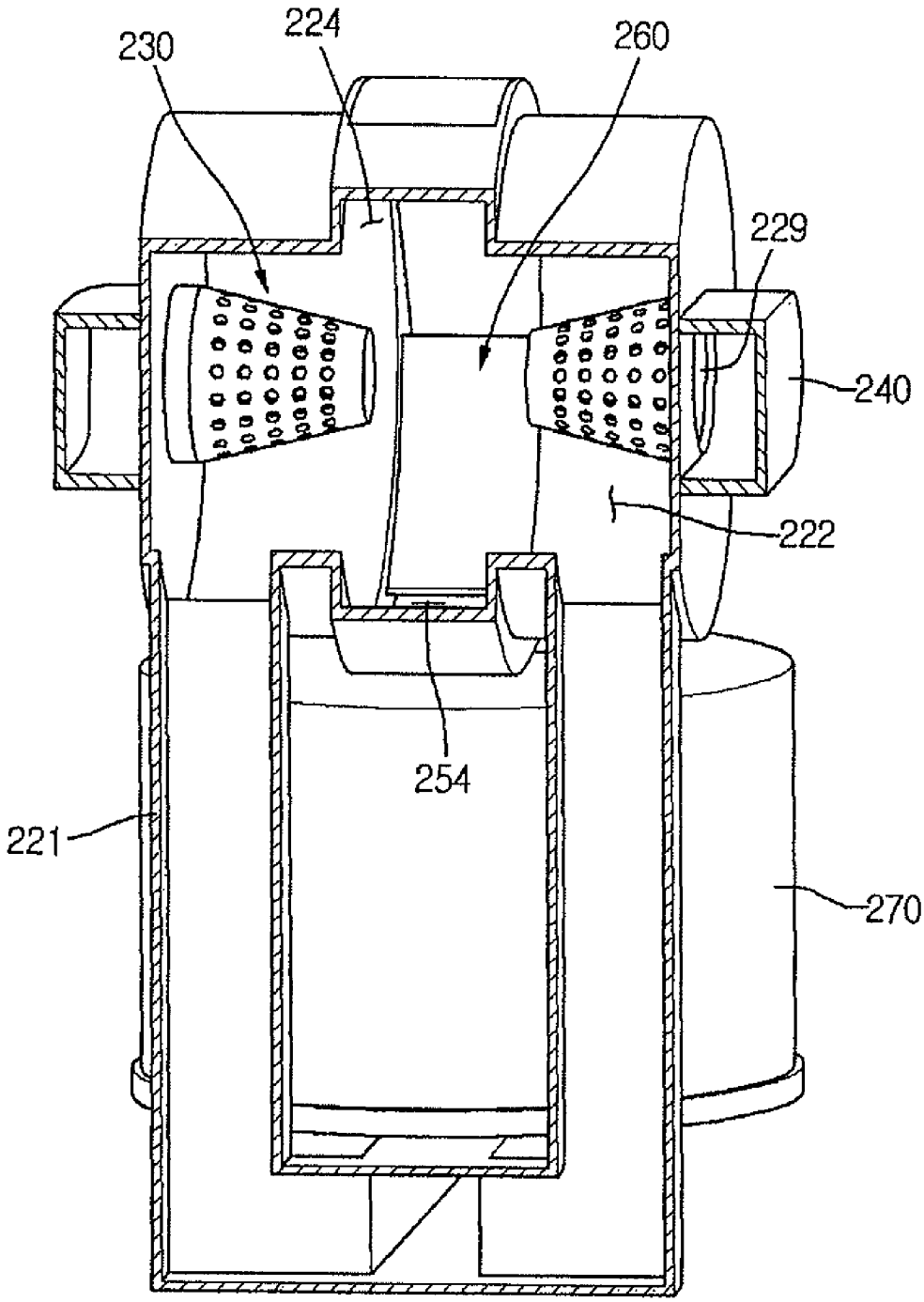
FIG. 10 is a sectional view taken along line X-X of FIG. 8.
Figure 11:
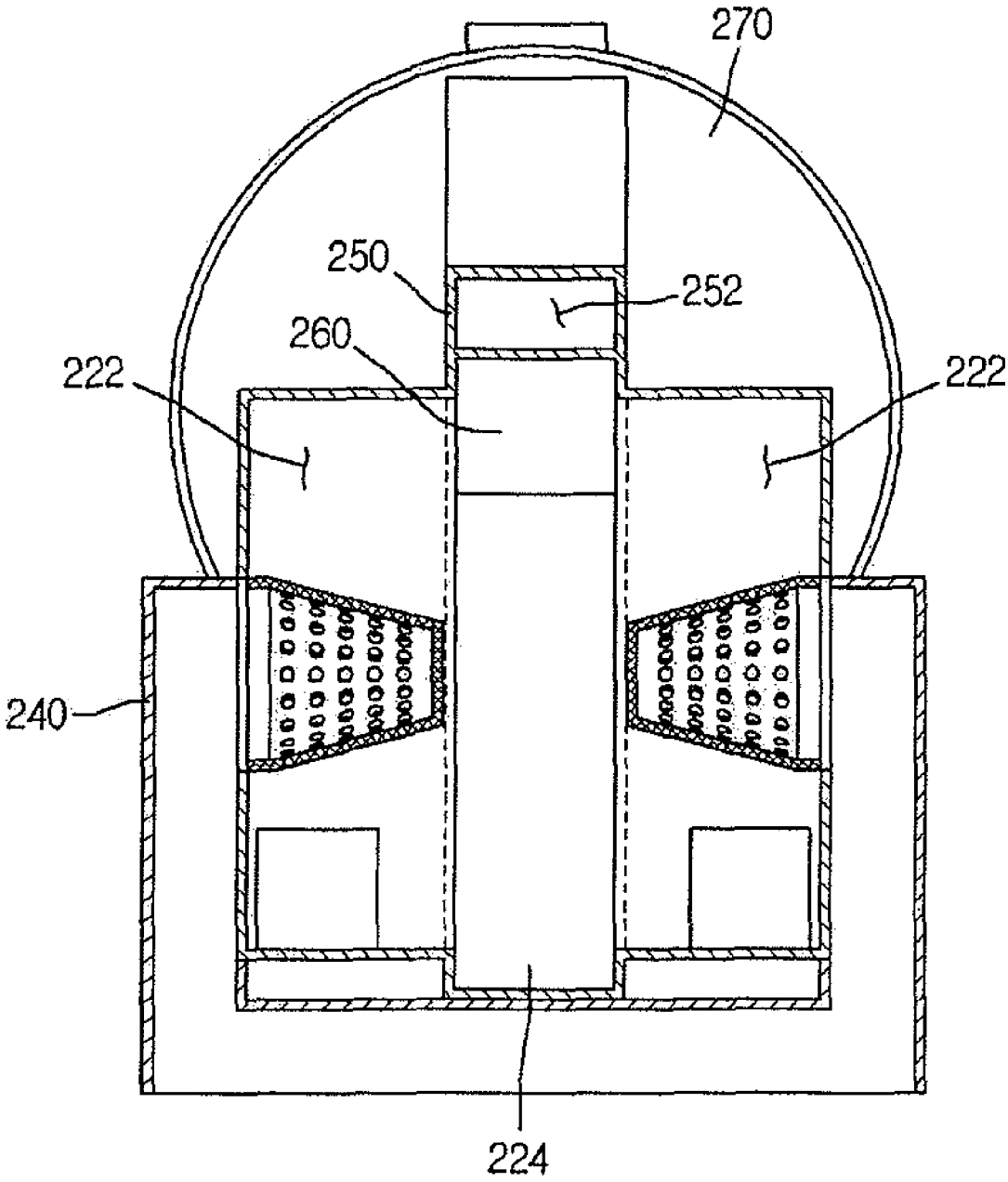
FIG. 11 is a sectional view taken along line XI-XI of FIG. 8.

Referring to FIGS. 9 to 11, a pair of air inlets 221 is formed (one at either side) of the cyclone 220. Accordingly, when air is suctioned through the air inlets 221, a pair of cyclone airflows is generated within the cyclone 220. The pair of cyclone airflows generated at both sides of the cyclone 220 converge at the center, and separated dust converges at the center and is discharged to the dust container 270 through the dust outlet 250. Accordingly, the inner space of the cyclone 220 can be divided into a dust separating region 222 at either side in which dust is separated through the cyclone airflows, and a dust outlet region 224 formed between the dust separating regions 222 in which dust converges and is discharged. That is, the dust separating region 222 is formed at either side of the dust outlet region 224. Also, the vertical sectional area of the dust outlet region 224 has a greater value than the vertical sectional area of the dust separating regions 222.

The inside of the dust outlet 250 includes a passage guide 260 to guide air that flows to the dust container 270 during the discharging of dust so the air enters the cyclone 220. That is, the passage guide 260 divides the inner space of the dust outlet 250 such that a dust outlet passage 252 and an air return passage 254 are formed in the dust outlet 250. In particular, the passage guide 260 includes a first guide 262 extending vertically, a second guide 264 with a predetermined curvature extending from the top of the first guide 262 toward the dust outlet region 224, and a third guide 266 extending horizontally from the bottom of the first guide 262.

The first guide 262 functions to divide the inner space of the dust outlet 250 into two passages—namely, the dust outlet passage 252 and the air return passage 254. The second guide 264 is formed to have a curvature corresponding to that of the dust outlet region 224. Thus, the second guide 264 functions to maintain the cyclone airflow in the dust outlet region 224. Additionally, the second guide 264 allows air returning through the dust outlet region 224 through the air return passage 254 to easily mix with the cyclone airflow in the dust outlet region 224. The third guide 266 has an opening 267 formed therein to allow air in the dust container 270 to pass therethrough and dust to be filtered out. That is, through the opening 267, dust in the dust container 270 is prevented from flowing into the dust outlet region 224 through the air return passage 254. Therefore, the third guide 266 functions as a filter member that filters dust.

As described above, because air within the dust container 270 is returned to the cyclone 220 through the air return passage 254, large impurities such as tissue paper are prevented from attaching to the inside of the dust outlet passage 252 and causing a reduction in suctioning force, and airflow is uninterrupted to maintain a uniform level of suctioning force. Specifically, if dust or large impurities block the dust outlet passage 252, separated dust cannot be discharged to the dust container 270, and the separated dust is stored in the dust separating unit 10, such that the stored dust impedes flow of air. However, when an air return passage 254 communicating between the dust container 270 and the cyclone 220 is formed, vacuum pressure generated by a vacuum motor provided in the main body of the vacuum cleaner continuously acts upon the air return passage 254, and the vacuum pressure allows dust or large impurities block the dust outlet passage 252 to be discharged to the dust container, so that airflow can be uniformly maintained. Also, when airflow is uniformly maintained, reduction in suctioning force is prevented, and suctioning force can be uniformly maintained.

A description on the operation of a dust separating apparatus according to the second exemplary embodiment is provided. Air including dust passes through the pair of inlets 221 and is suctioned into the cyclone 220 in a tangential direction to the cyclone 220.

The suctioned air circulates in the dust separating regions 222 at either side of the system 220 and converges at the dust outlet region 224, and in this process, air and dust are separated due to different centrifugal forces they receive based on their differing weights.

The separated dust (represented by the broken lines) circulates in the dust outlet region 224 and is discharged in a tangential direction to the dust outlet passage 252, and the discharged dust flows through the dust outlet passage 252 and enters the dust container 270. Here, not only dust, but a portion of the air is also discharged through the dust outlet passage 252. Conversely, air (represented by the solid lines) separated from dust is filtered by the filter member 230, and then passages through the outlet 229 to be discharged from the cyclone 220. The discharged air flows through the air outlet 240.

The air that enters the dust container 270 passes through the opening 267 and flows to the air return passage 254 to be returned to the dust outlet region 224 and mixes with the cyclone airflow in the dust outlet region 224.

Having described a dust separator for a vacuum cleaner according to a second exemplary embodiment above, a dust separator for a vacuum cleaner according to a third exemplary embodiment will be described with reference to FIG. 12. The third exemplary embodiment is the same as the second exemplary embodiment in all other aspects except for the structure of the passage guide. Therefore, description will be provided of only the distinguishing portions of the third exemplary embodiment, and the description of portions that are the same as in the second exemplary embodiment will be omitted.

Figure 12:
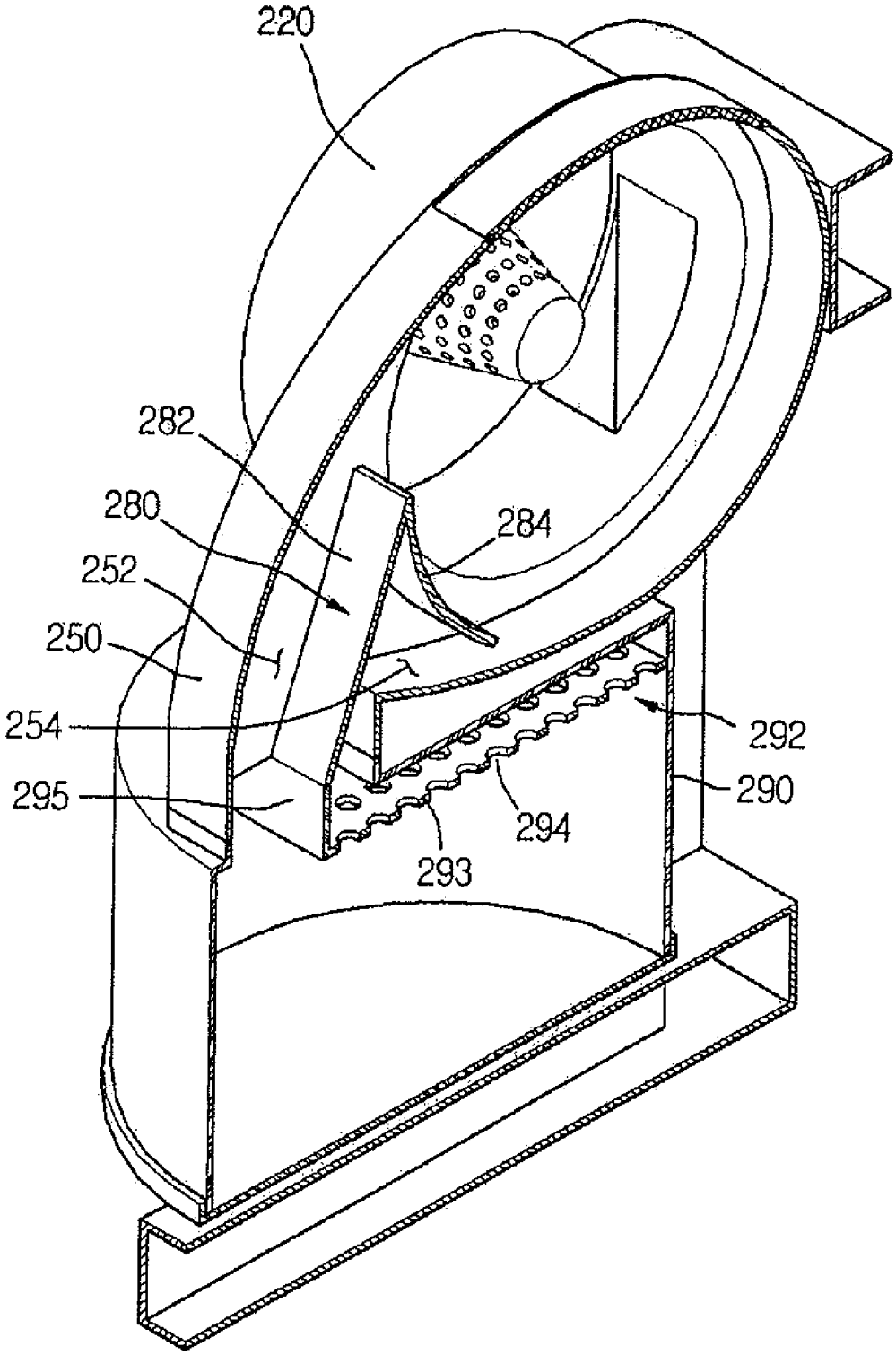
FIG. 12 is a perspective sectional view of a dust separating apparatus according to a third exemplary embodiment of the present invention.

Referring to FIG. 12, an air return passage 254 according to the present exemplary embodiment includes a first passage guide 280 formed on the cyclone 220, and a second passage guide 292 formed on the dust container 290.

In particular, the first passage guide 280 includes a first guide 282 extending vertically within the dust outlet 250, and a second guide 284 with a predetermined curvature extending from the top of the first guide 282. As the shapes and functions of the first guide 282 and the second guide 284 are the same as those of the second exemplary embodiment, a detailed description thereof will not be provided again. The second passage guide 292 includes a horizontal guide 293 formed to provide a predetermined gap from the upper surface of the dust container 290, and a vertical guide 295 extending upward from one end of the horizontal guide 293. Also, the horizontal guide 293 has a plurality of openings 294 formed therein to filter discharged air. Therefore, the horizontal guide 293 functions as a filter member for filtering air. When the cyclone 220 and the dust container 290 are connected, the bottom of the first guide 282 and the top of the vertical guide 295 contact each other.

As described above, when the second passage guide 292 is formed in the dust container 290, a passage for air can be formed in the dust container 290, and the area of the air passage is enlarged by the horizontal guide 293, allowing air to be returned more easily through the air return passage 254.

Figure 13:
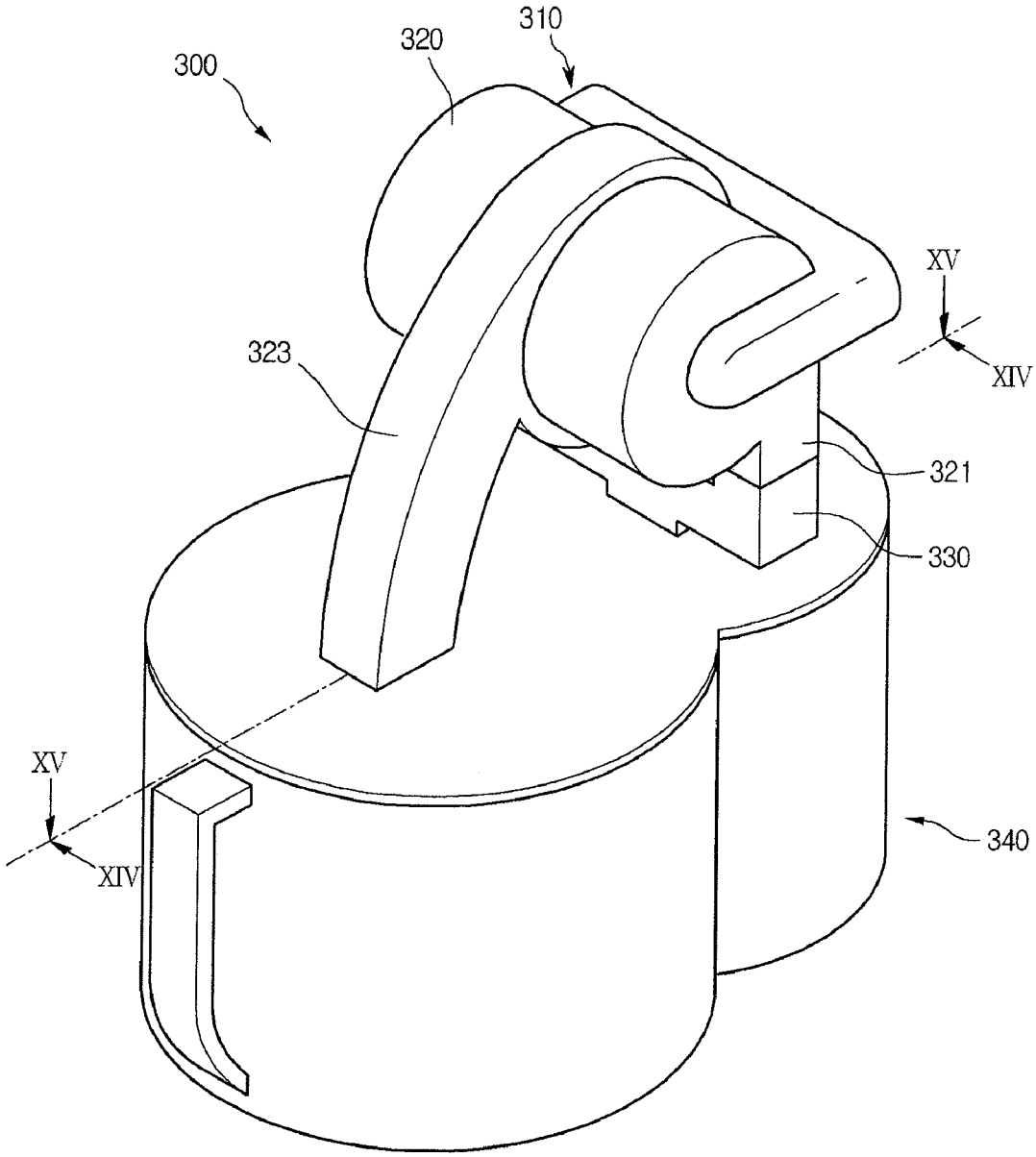
FIG. 13 is a perspective view of a dust separating apparatus according to a fourth exemplary embodiment of the present invention.

Referring to FIG. 13, a dust separating apparatus 300 of a vacuum cleaner according to a fourth exemplary embodiment includes a dust separating unit 310 that separates dust from suctioned air, a dust container 340 for storing dust separated by the dust separating unit 310, and a distribution unit 330 allowing air that passes through the dust separating apparatus to flow to the dust separating unit 310. The dust separating unit 310 includes a cyclone 320 generating a pair of cyclone airflows. The cyclone 320 has a pair of inlets 321 formed therein to suction air. The inlets 321 are respectively connected to the distribution unit 330. The distribution unit 330 allows air discharged from the dust container 340 to be divided into two passages.

Figure 14:
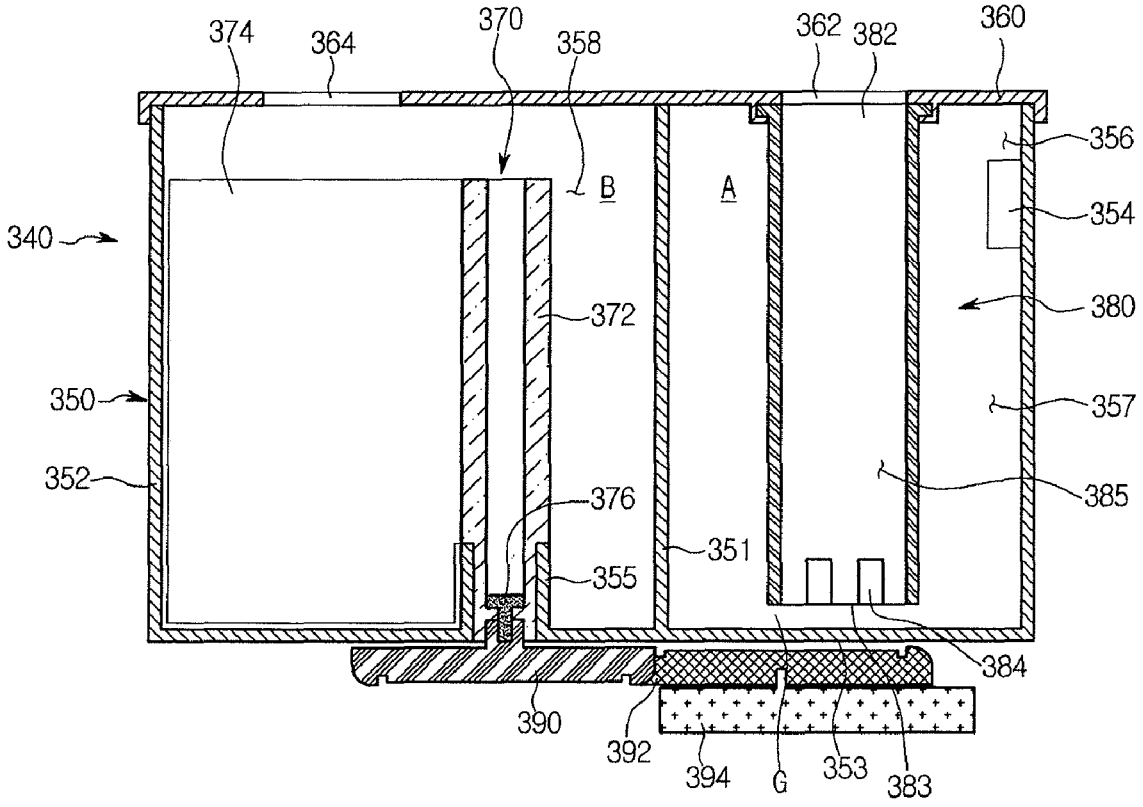
FIG. 14 is a sectional view taken along line XIV-XIV of FIG. 13.
Figure 15:
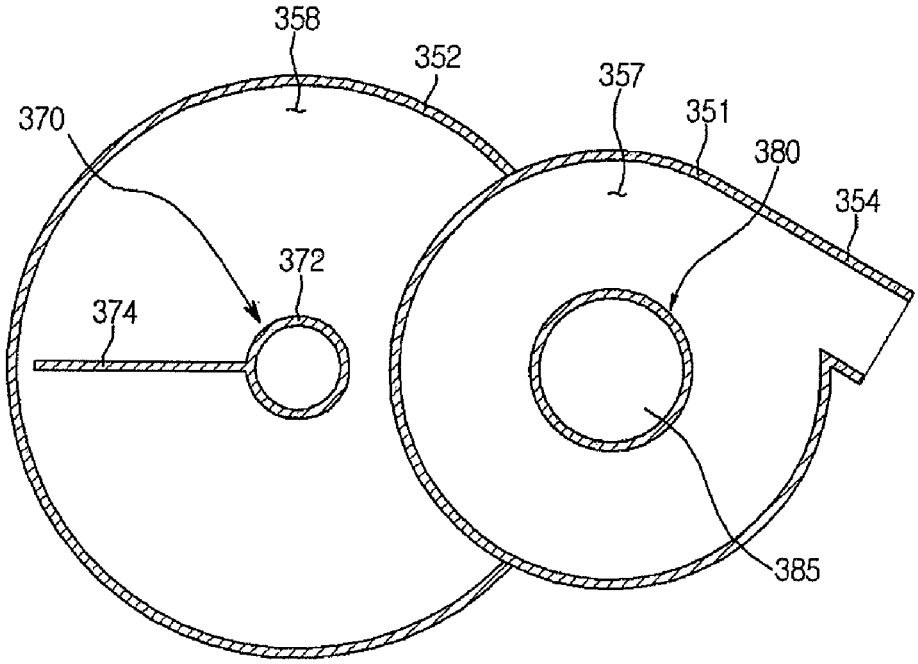
FIG. 15 is a sectional view taken along line XV-XV of FIG. 13.

Referring to FIGS. 14 and 15, the dust container 340 includes a dust body 350 defining the external shape of the dust container 340, and a cover member 360 connected to the top of the dust body 350. In particular, the dust body 350 includes a first wall 351 that is cylindrical, a second wall 352 enclosing a portion of the first wall 351, and a third wall 353 forming the lower surface of the dust body 350. The second wall 352 also has an approximately cylindrical shape. The radius of the second wall 352 is greater than the radius of the first wall 351.

Accordingly, the dust body 350 includes a first space (A) defined within the first wall 351, and a second space (B) defined between the first wall 351 and the second wall 352. The bottom of the first space (A) functions as a first dust storage 357. The second space (B) functions as a second dust storage 358. Here, the cover member 360 defines the top surface of the second dust storage 358. The second dust storage 358 also stores dust separated by the dust separating unit 310.

The first wall 351 has an inlet 354 formed therein to suction air including dust. The first dust storage 357 has a separating guide 380 disposed therein to separate tissue paper and other large impurities from air. Accordingly, air including dust that passes through the inlet 354 into the inside of the space defined by the first wall 351 undergoes a dust separating process by means of the separating guide 380 within the space defined by the first wall 351. That is, the air and dust suctioned through the inlet 354 flows downward, and air and dust are separated while flowing downward. Accordingly, the upper portion of the first wall 351 defines a separating chamber 356 in which dust is separated from air. That is, the top of the first space (A) functions as a dust separating chamber 356, and the bottom of the first space (A) functions as a first dust storage 357. While the dust separating chamber 356 has been described as being functionally divided from the first dust storage 357 in the first space (A), the dust separating chamber 356 and the first dust storage 357 are not structurally partitioned. Thus, for example, when a large amount of dust amasses in the first space (A), the first dust storage 357 may be defined as the entire first space (A).

Dust separated in the dust separating chamber 356 is stored in the first dust storage 357, and air flows into the separating guide 380. The separating guide 380 is coupled to the bottom of the cover member 360. The cover member 360 is coupled to the dust body 350, and the separating guide 380 is inserted into the inner space defined by the first wall 351. The separating guide 380 is formed in a cylindrical shape with openings 382 and 383 defined in the upper and lower surfaces, respectively. Therefore, an outlet passage 385 through which air is discharged is defined within the separating guide 380. Air that enters the outlet passage 385 passes through the outlet 362 and flows to the distribution unit 330.

The lower end of the separating guide 380 is separated a predetermined distance from the lower wall 353 and a plurality of through-holes 384 is formed in the bottom of the separating guide 380 to allow air to enter the outlet passage 385. Accordingly, air in the first dust storage 357 passes through the opening 383 through the gap (G) between the separating guide 380 and the lower wall 353, and enters the outlet passage 385. The air in the first dust storage 357 may enter the outlet passage 385 through the through-holes 384.

Dust is separated in the dust separating unit 310 similar to those described above and enters the second dust storage 358. A dust inlet 364 is formed in the cover member 360 to allow dust separated in the dust separating unit 310 to enter.

A compressing member 370 is provided in the second dust storage 358 for compressing dust stored in the second dust storage 358. The compressing member 370 includes a hollow rotating shaft 372, and a compressing plate 374 extending from the rotating shaft 372. A fixing shaft 355 is formed extending upward on the lower wall 353 to couple the rotating shaft 372 to the lower wall 353. A portion of the rotating shaft 372 is inserted inside the fixing shaft 355. A driven gear 390 is coupled to the rotating shaft 372 to transfer power to the rotating shaft 372. The driven gear 390 is coupled from the outside of the dust body 350 to the lower end of the rotating shaft 372. A fastening member 376 is fastened to the driven gear 390 and the rotating shaft 372 to couple the driven gear 390 and the rotating shaft 372. The driven gear 390 is connected to a driving gear 392, and the driving gear 392 is coupled to the shaft of a compressing motor 394. The driving gear 392 and the compressing motor 394 may be provided in the main body of the vacuum cleaner (not shown). With the dust container 340 mounted in the main body of the vacuum cleaner, the driven gear 390 and the driving gear 392 are engaged.

Accordingly, when the shaft of the compressing motor 394 rotates, the driving gear 392 coupled to the compressing motor 394 is also rotated. When the driving gear 392 rotates, the driven gear 390 engaged to the driving gear 392 is also rotated. The compressing member 370 coupled to the driven gear 390 is rotated to compress the dust stored in the second dust storage 358. Here, the compressing motor 394 used may be a motor capable of rotating bi-directionally in order to allow the compressing member 370 to also rotate in either direction.

The operation of the dust separating apparatus will be described. Dust on a surface to be cleaned is first suctioned with air into the dust separating chamber 356 inside the space defined by the first wall 351 of the dust body 350. The air including the dust moves in a spiral flow direction along the inner surface of the dust separating chamber 356 and moves downward. The air and fine dust that moves downward passes through the through-holes 384 and the opening 383 to enter the outlet passage 385. Conversely, larger impurities such as tissue paper either wind around the separating guide 380 or lodge at the bottom end of the separating guide 380 during the process of descending.

The air and fine dust that enters the outlet passage 385 pass through the outlet 362 and flow to the distribution unit 330. The air and fine dust that moves to the distribution unit 330 enters the cyclone 320 through the respective inlets 321.

The air that enters the cyclone 320 moves in a spiral motion along the inner surface of the cyclone 320 and moves to the center of the cyclone 320. During this process, the air and fine dust receive different levels of centrifugal force due to their differing weight and are thus separated. The separated dust is discharged from the center of the cyclone 320 through the dust outlet 323. The dust discharged through the dust outlet 323 passes through the dust inlet 364 and enters the second dust storage 358 of the dust container 340. According to the present exemplary embodiment, impurities such as tissue paper are separated from air within the dust container 340, and the separated impurities are stored in the first dust storage 357 of the dust container 340.

After a second stage process of separating dust in the dust separating unit 10 is performed, the dust separated in the dust separating unit 10 is stored in the second dust storage 358 of the dust container 340.

According to the fourth exemplary embodiment, the larger impurities such as tissue paper are separated in a first stage in the dust container, to prevent large impurities from entering the dust separating unit 310. Because large impurities do not enter the dust separating unit 310, airflow being impeded in the dust separating unit 310 by large impurities can be prevented. Also, because large impurities such as tissue paper are stored in the dust container 340, the stored impurities can easily be emptied.

Having described a dust container according to a fourth exemplary embodiment above, a dust container according to a fifth exemplary embodiment will be described with reference to FIG. 16. The fifth exemplary embodiment is the same as the fourth exemplary embodiment in all other aspects except for the structure of the separating guide. Therefore, description will be provided of only the distinguishing portions of the fifth exemplary embodiment, and the description of portions that are the same as in the fourth exemplary embodiment will be omitted.

Figure 16:
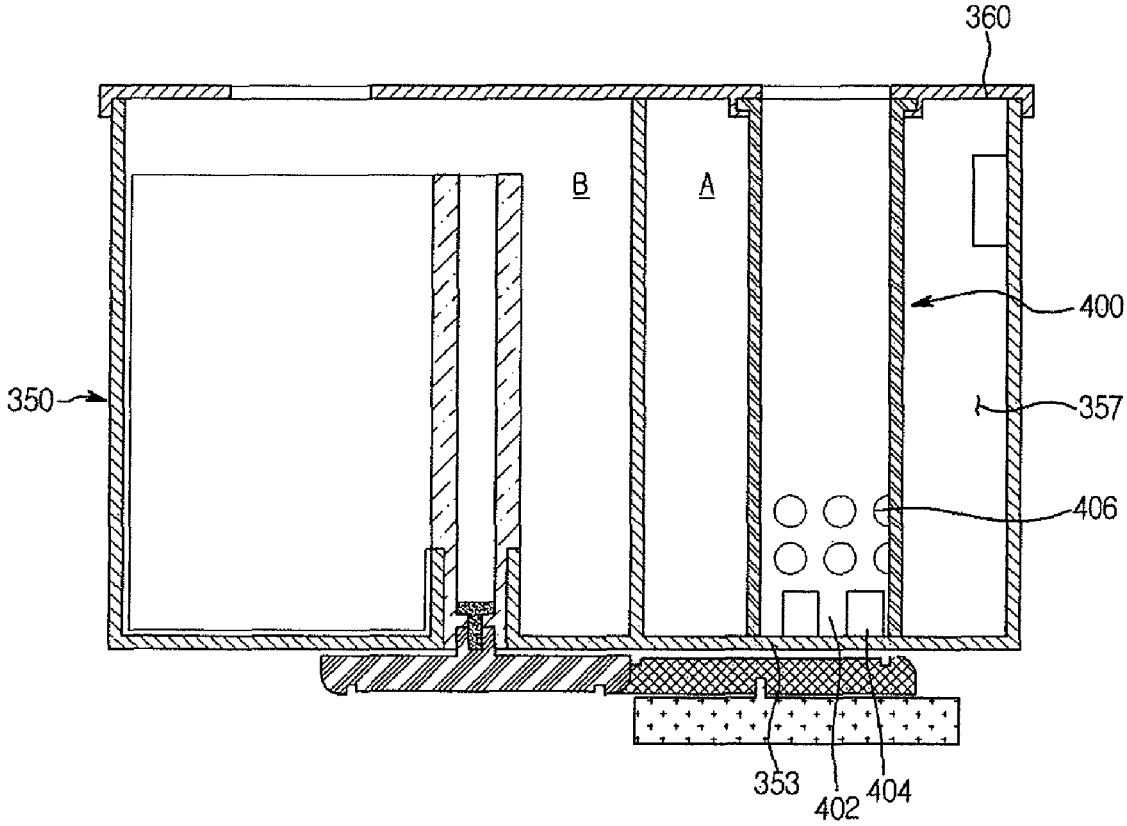
FIG. 16 is a sectional view showing the inner structure of a dust container according to a fifth exemplary embodiment of the present invention.

Referring to FIG. 16, a plurality of catching ribs 402 is formed at the bottom of the separating guide 400 in the present exemplary embodiment. The catching ribs 402 extend downward at the lower peripheral portion of the separating guide 400, and are spaced apart from one another. The lower ends of the catching ribs 402 are pressed against the lower wall 353 of the dust body 350. The separated catching ribs 402 define inlet holes 404 therebetween through which air in the first dust storage 357 flows into the separating guide 400. Also, auxiliary inlet holes 406 are formed at the bottom of the separating guide 400 to allow easy entrance of air into the separating guide 400.

In another aspect, the separating guide 400 may have its bottom surface pressed against the lower wall 353 of the dust body 350, and the inlet holes 404 may be formed at the bottom of the separating guide 400, so that the catching ribs 402 may be defined by the inlet holes 404.

Having described a dust container according to a fourth exemplary embodiment previously, a dust container according to a sixth exemplary embodiment will be described with reference to FIGS. 17-19. The sixth exemplary embodiment is the same as the fourth exemplary embodiment in all other aspects except for differences in the separating unit and the dust storage. Therefore, description will be provided of only the distinguishing portions of the sixth exemplary embodiment, and the description of portions that are the same as in the fourth exemplary embodiment will be omitted.

Figure 17:
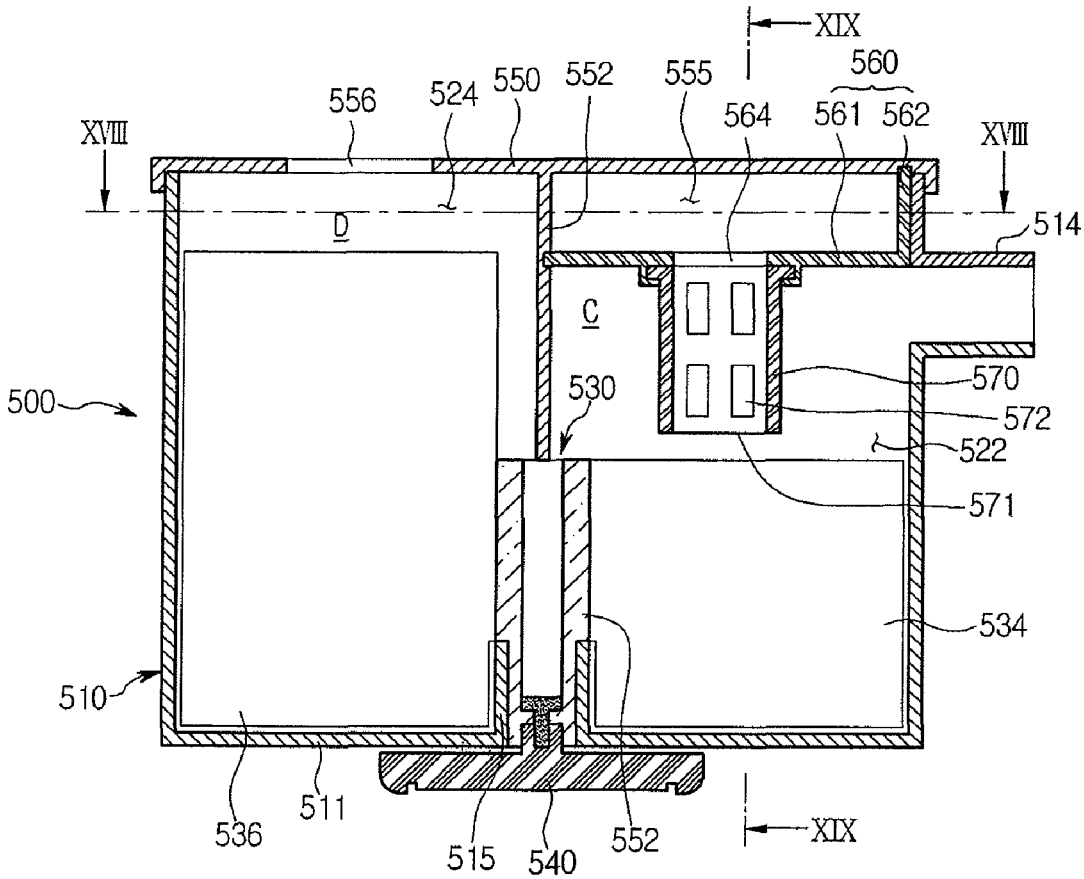
FIG. 17 is a sectional view showing the inner structure of a dust container according to a sixth exemplary embodiment of the present invention.
Figure 18:
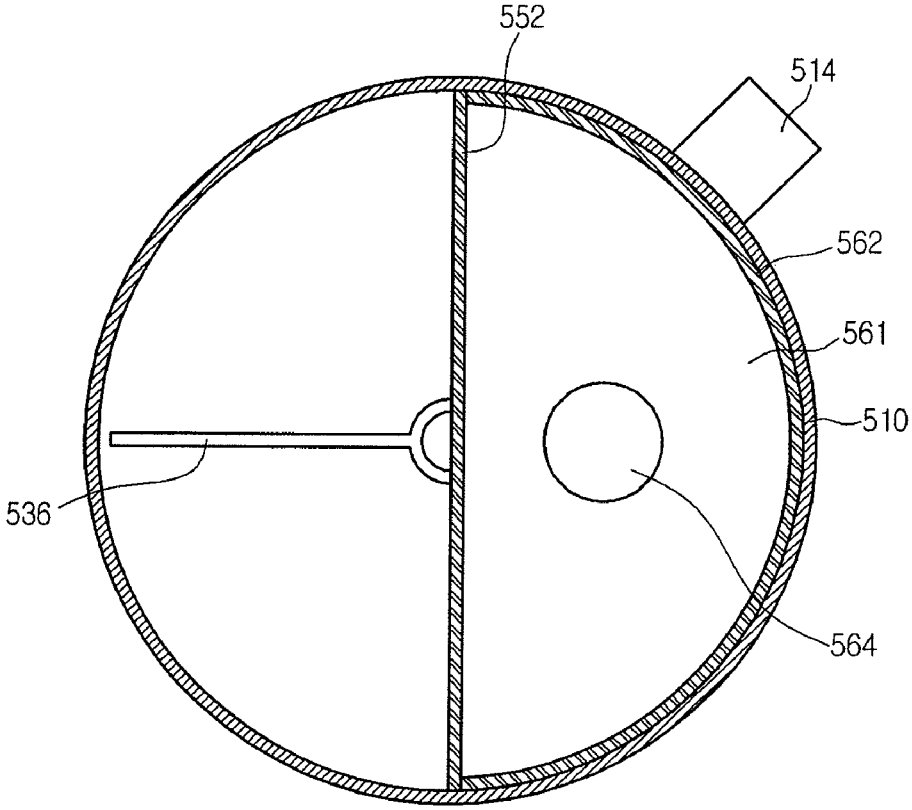
FIG. 18 is a sectional view taken along line XVIII-XVIII of FIG. 17.
Figure 19:
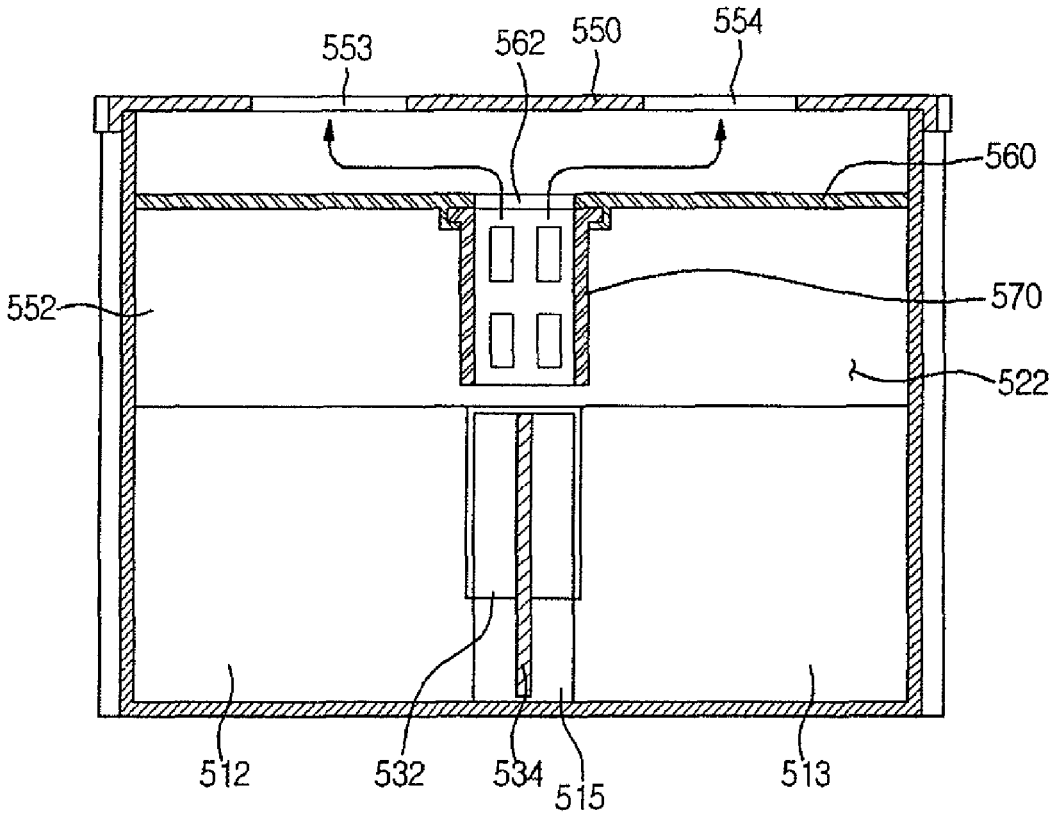
FIG. 19 is a sectional view taken along line XIX-XIX of FIG. 17.

Referring to FIGS. 17 to 19, a dust container 500 according to the present exemplary embodiment includes a dust body 510 defining the external shape of the dust container 500, a cover member 550 for selectively opening and closing the top of the dust body 510, and a plurality of partitions for partitioning the inner space of the dust body 510 into a first space (C) and a second space (D).

In particular, the dust body 510 is cylindrical in shape. The partitions include a first partition 512 and a second partition 513 formed in the dust body 510, and a third partition 552 formed on the cover member 550. The first and second partitions 512 and 513 extend from the inner periphery of the dust body 510 toward the center of the dust body 510, and the first and second partitions 512 and 513 are formed in a straight line. The first and second partitions 512 and 513 are also separated by a predetermined distance. A rotating shaft of a compressing member (to be described) is disposed in the space between the first and second partitions 512 and 513. That is, a space is formed between the first and second partitions 512 and 513 to accommodate the rotating shaft.

The third partition 552 is disposed vertically above the first and second partitions 512 and 513. In particular, when the cover member 550 is coupled to the dust body 510, the third partition 552 is positioned on the upper surface of the first and second partitions 512 and 513. Here, the first space (C) functions as a first dust storage 522, and the second space (D) functions as a second dust storage 524.

An inlet 514 is formed in the dust body 510. The inlet 514 is formed at a side of the first dust storage 522. A separating guide 570 is disposed in the first dust storage 522 to separate large impurities such as tissue paper from dust suctioned through the inlet 514. Specifically, the separating guide 570 is coupled to the cover member 550. An opening 571 is formed at the bottom of the separating guide 570 through which air in the first dust storage 522 enters. The separating guide 570 has an inlet 572 formed in a sidewall thereof for air to flow into the separating guide 570.

A flow guide 560 is formed on the cover member 550 to guide the air flowing along the separating guide 570. In particular, the flow guide 560 includes a lower surface guide 561 separated a predetermined distance from the bottom surface of the cover member 550, and a side surface guide 562 connecting the lower surface guide 561 and the cover member 550. The lower surface guide 561 may be coupled to the third partition 552 through press fitting, and the side surface guide 562 may be coupled to the cover member 550 through press fitting. The lower surface guide 561, as shown in FIG. 18, is formed in a semicircular shape. When the flow guide 560 is coupled to the cover member 550, an air passage 555 is defined by the undersurface of the cover member 550, the flow guide 560, and the third partition 552.

A through-hole 564 is defined in the lower surface guide 561 to allow air that enters the inside of the separating guide 570 to flow to the air passage 555. The separating guide 570 is coupled around the through-hole 564.

A pair of outlets 553 and 554 is defined in the cover member 550 to allow air in the air passage 555 to branch and flow through the respective inlets 321 of the cyclone 320 similar to that shown in the fourth exemplary embodiment. That is, the sixth exemplary embodiment, unlike the fourth exemplary embodiment, provides a distribution unit in the dust container 500. Here, the outlets 553 and 554 function as branching passages.

A dust inlet 556, through which dust separated in the cyclone 320 enters, is formed in the cover member 550. A compressing member 530 for compressing dust is provided in the dust container 500. The compressing member 530 simultaneously compresses dust stored in the first dust storage 522 and in the second dust storage 524. In particular, the compressing member 530 includes a rotating shaft 532, a first compressing plate 534 for compressing dust stored in the first dust storage 522, and a second compressing plate 536 for compressing dust stored in the second dust storage 526. The first compressing plate 534 and the second compressing plate 536 are integrally formed with the rotating shaft 532 and are formed in a straight line. That is, the first compressing plate 534 and the second compressing plate 536 form a 180° angle therebetween. The vertical length of the second compressing plate 536 is greater than the vertical length of the first compressing plate 534.

A fixing shaft 515 is formed to protrude upward from the lower wall 511 of the dust body 510. A portion of the rotating shaft 532 is inserted into the fixing shaft 515. A driven gear 540 is coupled to the rotating shaft 532 to transfer driving force to the rotating shaft 532. The driven gear 540, as in the fourth exemplary embodiment, is rotated by a driving gear and a compressing motor. The rotating method of the compressing member is the same as in the fourth exemplary embodiment, and thus, a detailed description thereof will not be provided. In the above exemplary embodiment, one compressing member 530 may be used to simultaneously compress dust stored in the respective dust storages 522 and 524, thereby maximizing the dust storage capacity of the dust container.

Figure 20:
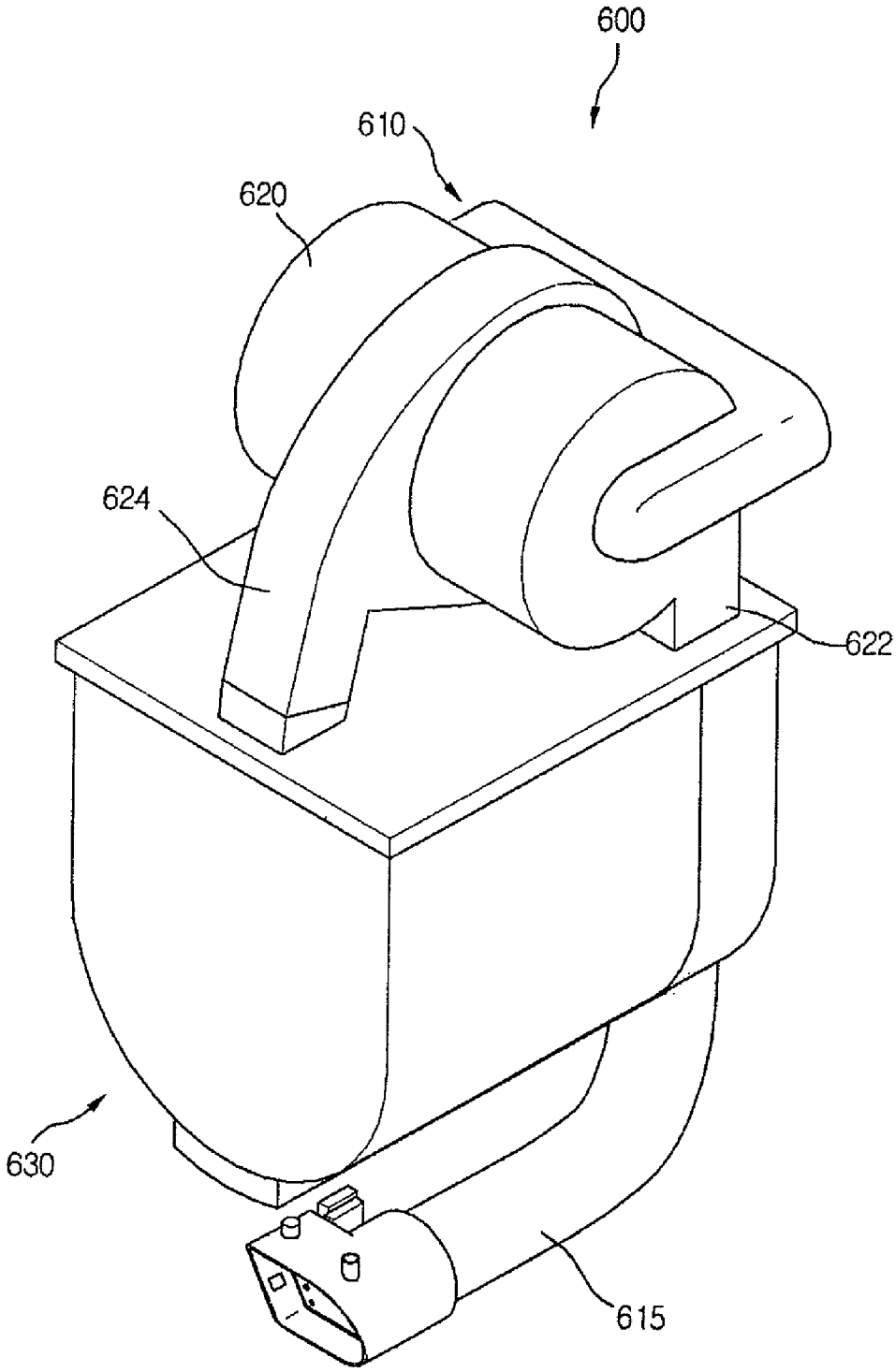
FIG. 20 is a perspective view of a dust separating apparatus according to a seventh exemplary embodiment of the present invention.

Referring to FIG. 20, a dust separating apparatus 600 according to a seventh exemplary embodiment includes a main separating unit 610 for separating dust from suctioned air, a dust container 630 for storing the dust separated by the main separating unit 610, and a suctioning guide 615 for guiding the flow of air including dust to the dust container 630. Air flowing through the suctioning guide 615 passes through the dust container 630 and then flows to the main separating unit 610.

The main separating unit 610 includes a cyclone 620 for generating a pair of cyclone airflows. A pair of inlets 622 is formed (one on either side of the cyclone 620), to suction air from inside the dust container 630. A dust outlet 624 is formed at the center of the cyclone 620 to discharge dust separated inside the cyclone 620.

Figure 21:
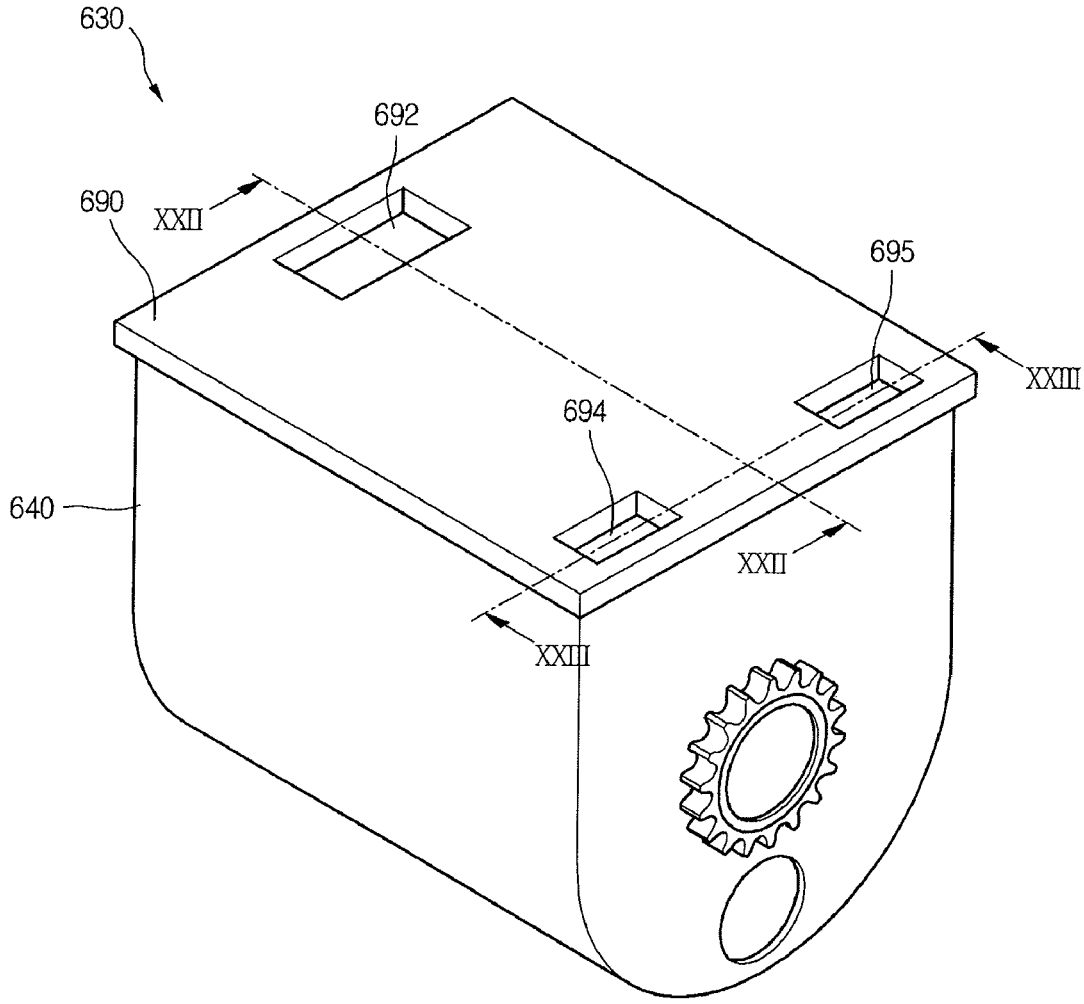
FIG. 21 is a perspective view of a dust container according to the seventh exemplary embodiment.
Figure 22:
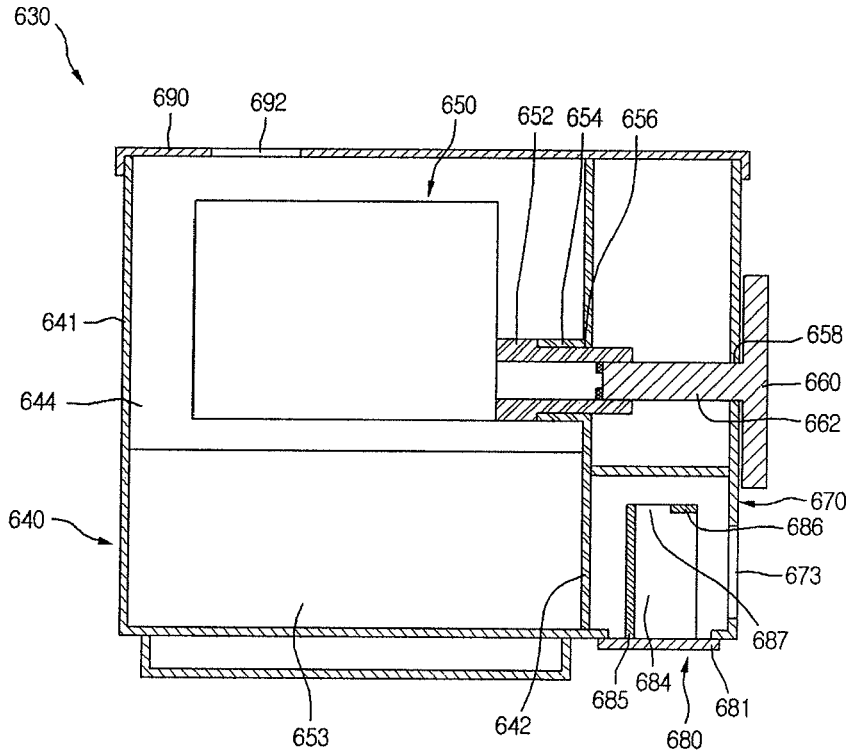
FIG. 22 is a sectional view taken along line XXII-XXII of FIG. 21.
Figure 23:
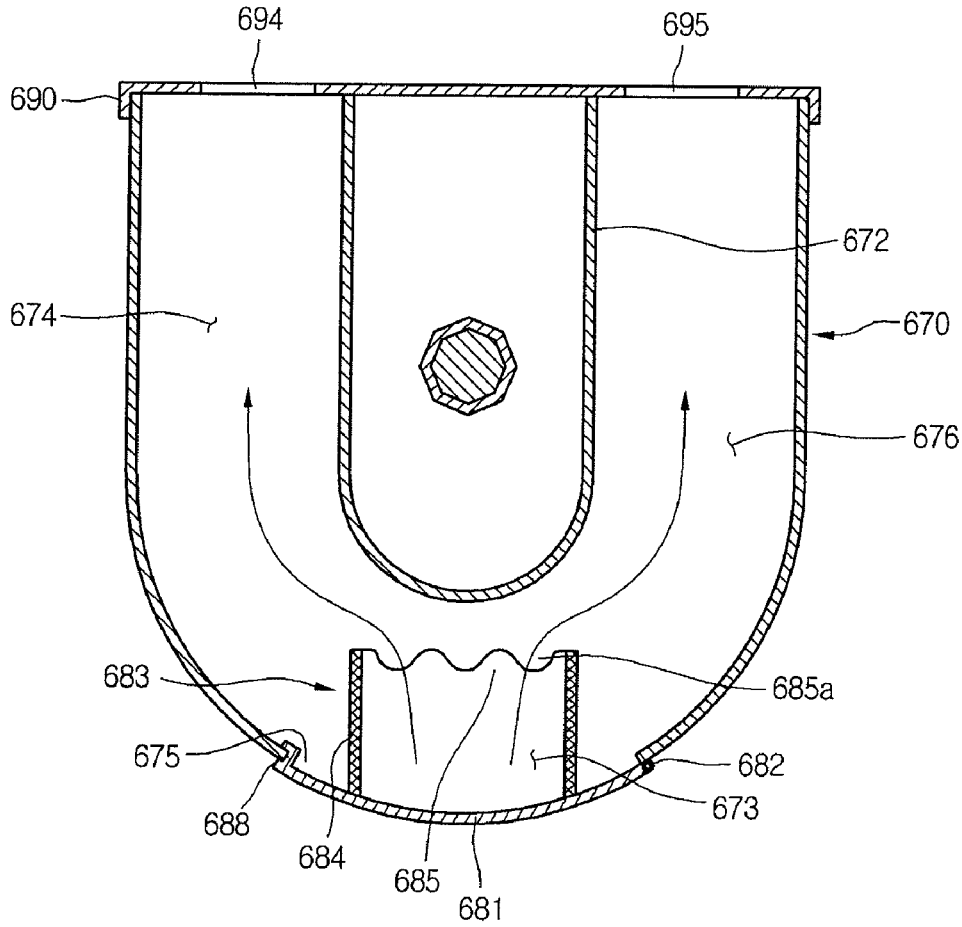
FIG. 23 is a sectional view taken along line XXIII-XXIII of FIG. 21.

Referring to FIGS. 21 to 23, the dust container 630 according to the seventh exemplary embodiment includes a dust body 640 and a cover member 690 coupled at the top of the dust body 640. In particular, the dust body 640 includes a first wall 641 constituting the overall external shape of the dust body 640, and a second wall 642 partitioning an inner space defined by the first wall 641 into two spaces.

A dust storage 644 for storing dust separated by the main separating unit 610, is formed to one side (the left side in FIG. 22) of the second wall 642, and a distribution unit 670, for distributing air that enters the inside of the dust body 640 to the main separating unit 610, is formed on the other side (the right side in FIG. 22).

A pair of compressing members is provided within the dust storage 644 to compress dust stored in the dust storage 644. In particular, the compressing member includes a fixing member 653 fixed to the inner periphery of the dust storage 644, and a rotating member 650 rotatably provided on the dust storage 644.

The fixing member 653 extends upward a predetermined height from the lower surface of the dust storage 644. A through-hole 656 is defined in the second wall 642, through which a rotating shaft 652 of the rotating member 650 passes. A guide rib 654 is formed to protrude on the second wall 642, to guide the rotation of the rotating shaft 652. When the rotating shaft 652 is passed through the through-hole 656, the rotating shaft 652 is pressed against the guide rib 654.

A portion of the rotating shaft 652 passes through the through-hole 656 and is disposed inside the distribution unit 670, and is coupled to a shaft 662 of a driven gear 660 passed through the first wall 641 forming the distribution unit 670. That is, the first wall 641 forming the distribution unit 270 has a through-hole 658 formed therein, through which the shaft 662 of the driven gear 660 passes.

Here, the driven gear 660 receives driving force from a driving gear (not shown) provided in the main body of the vacuum cleaner. The driving gear may be coupled to a compressing motor provided in the main body of the vacuum cleaner. A portion of the driving gear may be exposed to the outside of the vacuum cleaner main body. Thus, when the dust container 630 is installed on the vacuum cleaner main body, the driven gear 660 and the driving gear are engaged.

The distribution unit 670 is defined by a portion of the first wall 641 and the second wall 642. The distribution unit 670 includes a main passage 673 into which air discharged from the suctioning guide 615 enters, and a pair of branch passages 674 and 676 branching from the main passage 673. Here, while one pair of branch passages is described in the present exemplary embodiment, there is no limit to the number of branch passages that may be provided; however, the number of branch passages formed may be the same as the number of inlets 622 of the main separating unit 610. The distribution unit 670 includes an air inlet through which air enters the main passage 673. A partition 672 is formed in the distribution unit 670 to partition the branch passages 674 and 676. The partition 672 is formed in a "U" shape, and is integrally formed with the first wall 641 and the second wall 642.

An auxiliary separating unit 680 is coupled to the distribution unit 670, with a portion inserted inside the distribution unit 670 for separating large impurities such as tissue paper from air. In particular, the auxiliary separating unit 680 includes a dust separator 683 for separating large impurities such as tissue paper from air entering the main passage 673. Here, an opening 675 is defined in the distribution unit 670 to allow the dust separator 683 to be inserted in the distribution unit 670 when the auxiliary separating unit 680 is coupled.

The auxiliary separating unit 680 also includes a door 681 for opening and closing the opening 674. One side of the door 681 is rotatably coupled at a hinge 682 to the distribution unit 670, and the other side is detachably coupled to the distribution unit 670 by means of a fastening hook 688.

The dust separator 683 is withdrawn from the distribution unit 670 by rotating the door 681 to open the opening 674, and is disposed in the main passage 673 when the door 681 closes the opening 674.

Thus, in the seventh exemplary embodiment, when the door 681 is rotated to extrude the dust separator 683 to the outside of the distribution unit 670, dust caught in the dust separator 683 can easily be removed. Also, when the dust separator 683 is disposed in the main passage 673, it is spaced apart from the first wall 641 and the second wall 642.

The dust separator 683 includes a pair of guides 684 separated a predetermined distance from one another, a connector 685 connecting the ends of the guides 684 and disposed proximate to the second wall 642, and a catching member 686 connecting the tops of the pair of guides 684. As shown in FIG. 22, the width (W) of the catching member 686 is formed to be less than the width of the guides 684. The catching member 686 is spaced apart from the connector 685. Thus, a space 687 is formed between the catching member 686 and the connector 685 for air to flow through. A plurality of through-holes 685*a* through which air can pass is formed in the upper portion of the connector 685. Thus, the upper portion of the connector 685 is formed in an undulating shape by means of the through-holes 685*a*. A portion of air including dust that enters the main passage 682 passes through the space 687, and large impurities such as tissue paper are caught by the catching member 686 during the flow of air through the space 687.

The cover member 690 is coupled to the top of the dust body 640. With the cover member 690 coupled to the top of the dust body 640, it also covers a side of the dust storage 644 and a side of the distribution unit 670.

A dust inlet 692, for allowing air flowing through the dust outlet 624 to enter the inside of the dust storage 644, is defined in the cover member 690. Also, air outlets 694 and 695 are defined in the cover member 690 to discharge air in the respective branch passages 674 and 676 from the distribution unit 670.

A description will be given of the operation of the dust separating apparatus. Air including dust flows along the suctioning guide 615. The air flowing through the suctioning guide 615 passes through the air inlet 673 and enters the main passage 682 of the distribution unit 670. The air including dust that enters the main passage 682 branches and flows to the respective branch passages 674 and 676. Here, during the branching of the air including dust from the main passage 672 to the branch passages 674 and 676, large impurities such as tissue paper are caught on the catching member 686. The air that enters the respective branch passages 674 and 676 passes through the air outlets 694 and 695 and flows to the inlets 622 of the main separating unit 610. Here, the air that flows into the main separating unit 610 includes hair and fine dust particles. Air that passes through the respective inlets 622 and is suctioned into the cyclone 620 is subjected to a second dust separating process. The separated dust is discharged through the dust outlet 624 from the cyclone 620, and the discharged dust flows through the dust outlet 624 and enters the dust storage 214 of the dust container 630 through the dust inlet 692.

Figure 24:
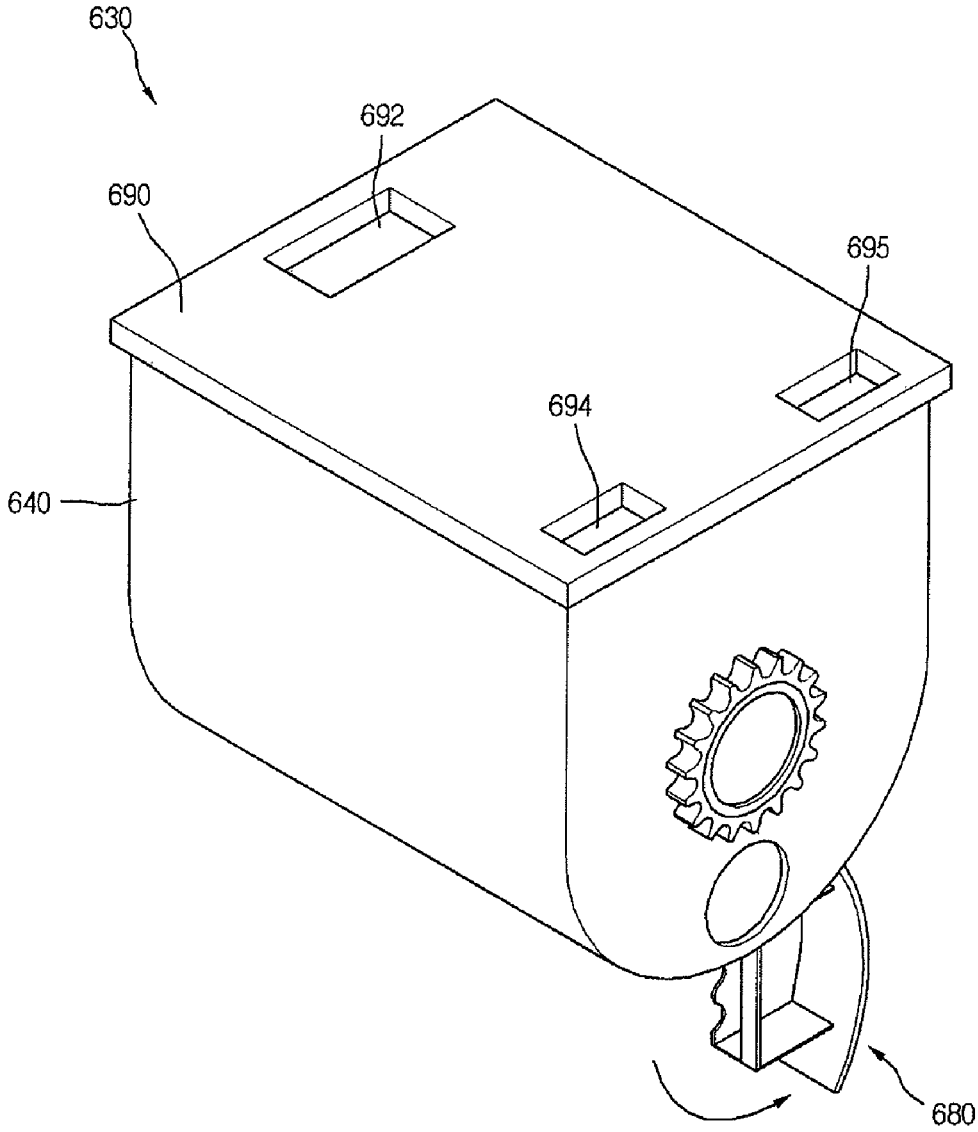
FIG. 24 is a perspective view showing an auxiliary separating unit drawn out of a dust collecting container according to the seventh exemplary embodiment.

Referring to FIG. 24, to remove dust caught on the catching member 686, the auxiliary separating unit 680 is pulled from below. Then, the auxiliary separating unit 680 rotates about the hinge 682, and the dust separator 683 with the catching member 686 formed thereon is withdrawn outside of the distribution unit 670. Here, with large impurities such as tissue paper caught on the catching member 686, the impurities are withdrawn with the dust separator 683. Accordingly, in the state extruded outside the distribution unit 670, a user can easily remove tissue paper, etc. from the dust separator 683.

Having described a dust separating apparatus according to a seventh exemplary embodiment above, a dust separating apparatus according to an eight exemplary embodiment will be described with reference to FIGS. 25-30. The eighth exemplary embodiment is the same as the seventh exemplary embodiment in all other aspects except for differences in the structure of the dust container. Therefore, description will be provided of only the distinguishing portions of the eighth exemplary embodiment, and the description of portions that are the same as in the seventh exemplary embodiment will be omitted.

Figure 25:
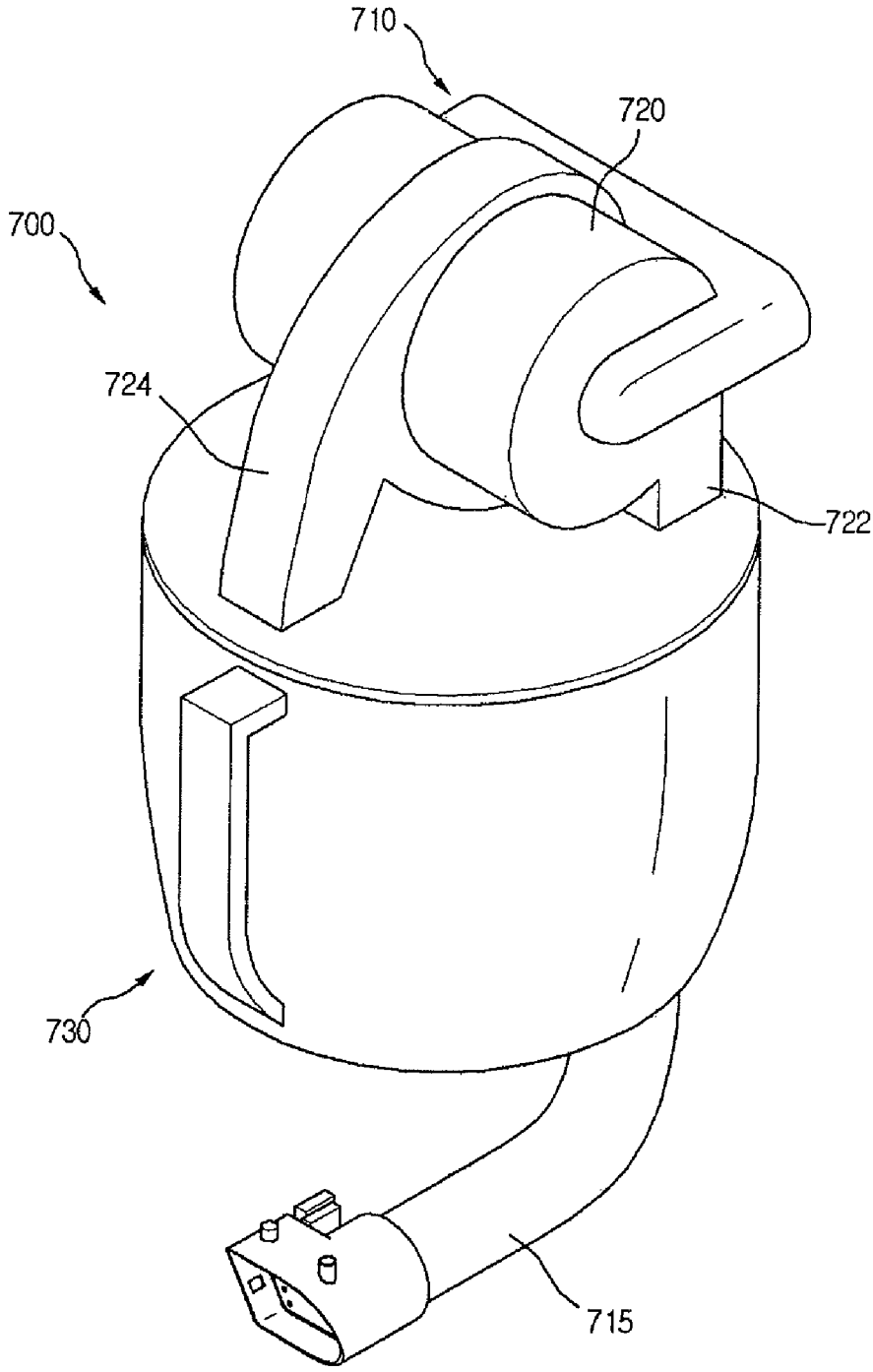
FIG. 25 is a perspective view of a dust separating apparatus according to an eighth exemplary embodiment of the present invention.
Figure 26:
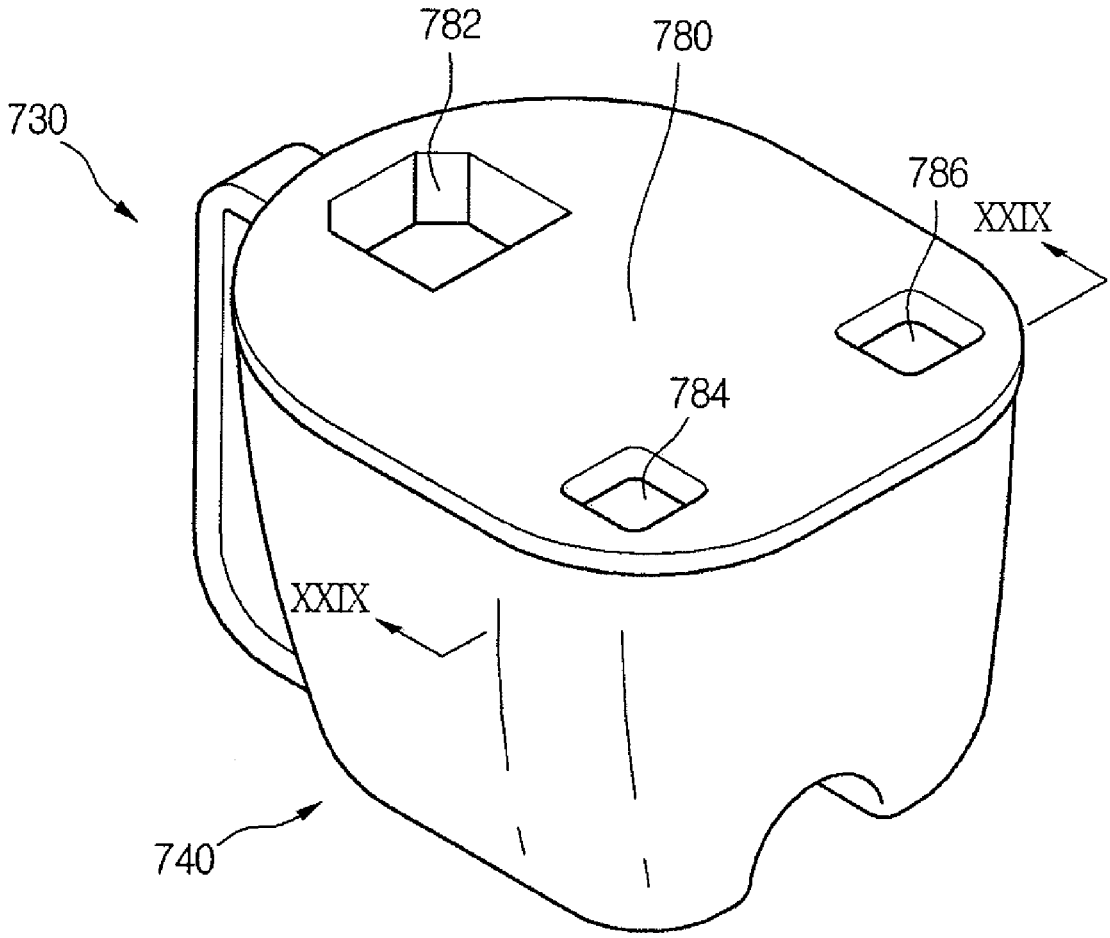
FIGS. 26 and 27 are perspective views of a dust container of the dust separating apparatus of FIG. 25.
Figure 27:
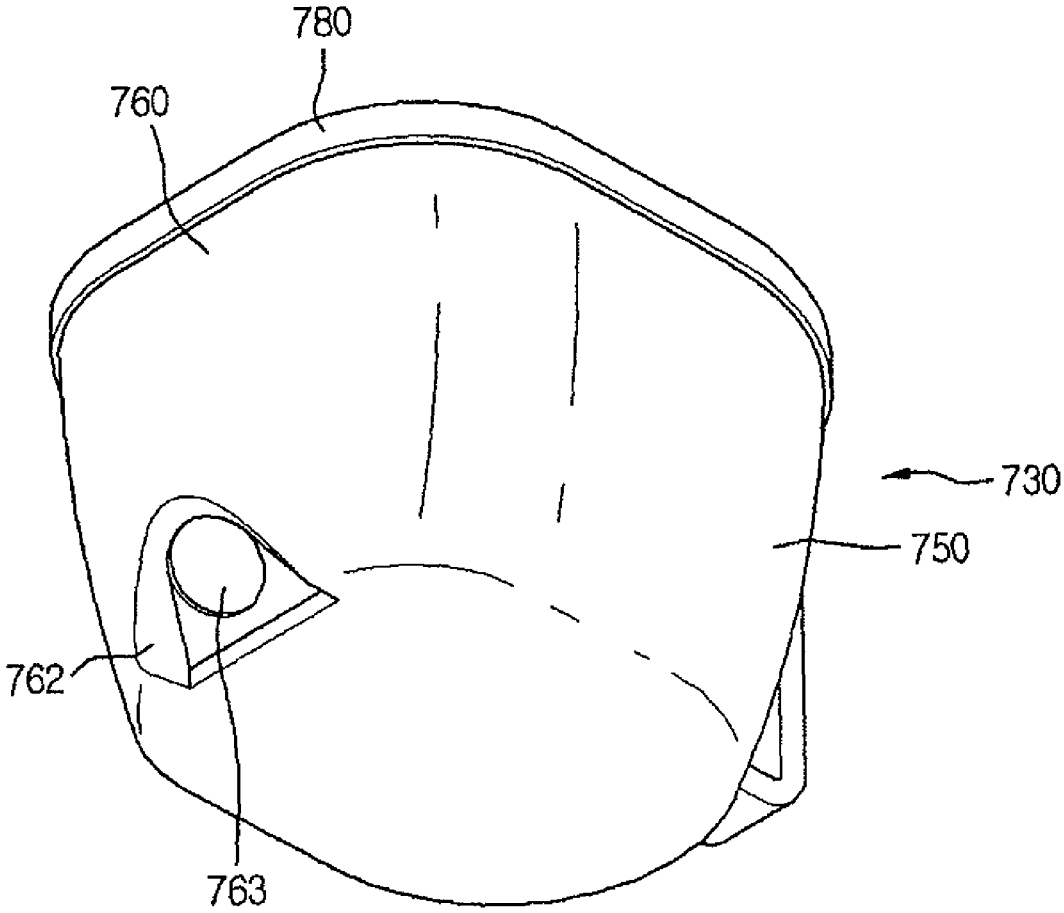

Referring to FIG. 25, a dust separating apparatus 700 according to the eighth exemplary embodiment includes a dust separating unit 710 for separating dust from suctioned air, a dust container 730 for storing dust separated by the dust separating unit 710, and a suctioning guide 715 for guiding the flow of air including dust to the dust container 730. Air flowing through the suctioning guide 715 passes through the dust container 730 and then flows to the dust separating unit 710.

The dust separating unit 710 includes a cyclone 720 that generates a pair of cyclone airflow. A pair of inlets 722 for suctioning air from inside the dust container 730 is formed with one at either side of the cyclone 720. A dust outlet 724 is formed in the central portion of the cyclone 720 to discharge dust separated within the cyclone 720.

Figure 28:
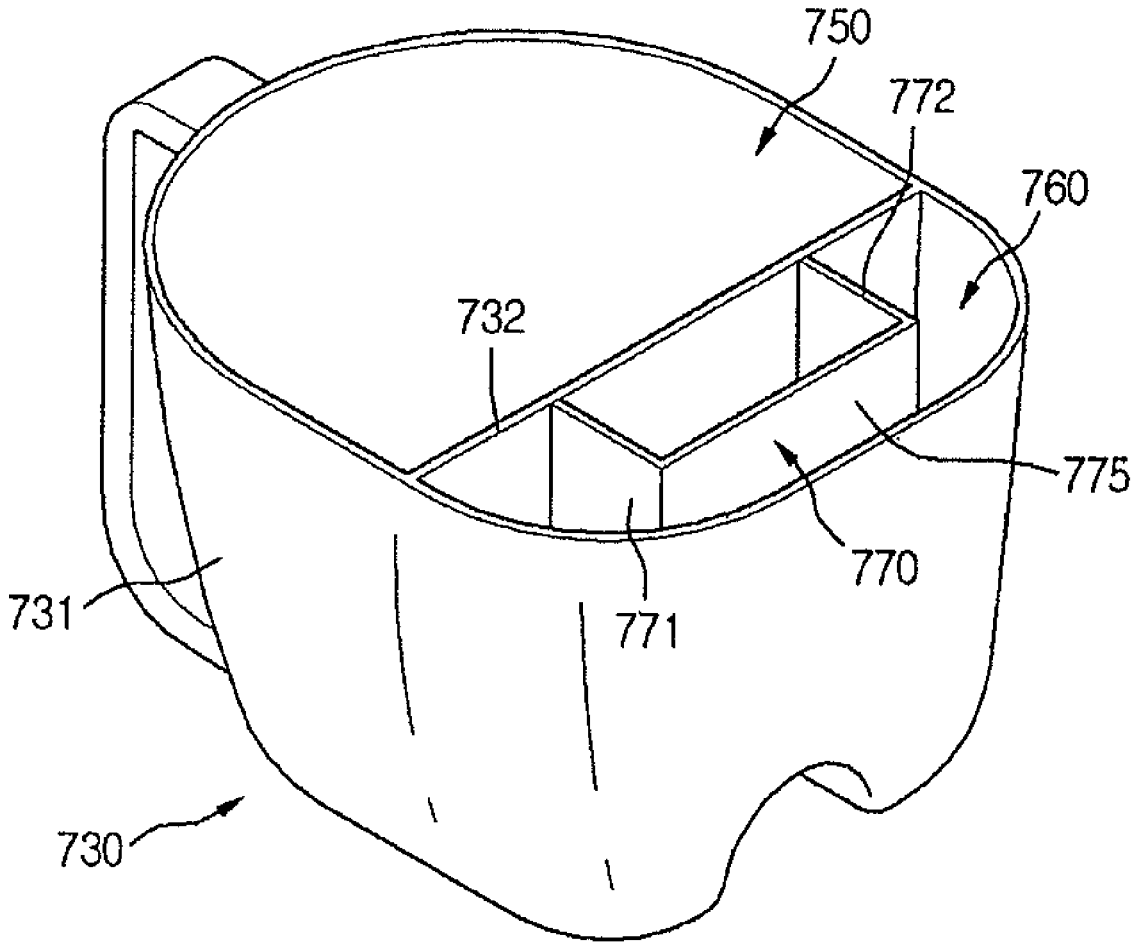
FIG. 28 is a perspective view of a dust body of the dust container of FIG. 25.

Referring to FIGS. 26 to 29, a dust container 730 according to the present exemplary embodiment includes a dust body 740 and a cover member 780 coupled at the top of the dust body 740. As shown in FIG. 28, the dust body 740 includes a first wall 731 forming the overall external shape of the dust body 740, and a second wall 732 partitioning the inner space defined by the first wall 731 into two spaces. A dust storage 750, in which dust separated in the dust separating unit 710 is stored, is formed at one side (the left side in FIG. 28) of the second wall 732, and a distribution unit 760 for distributing air that enters the inside of the dust body 740 to the dust separating unit is formed at the other side (the right side in FIG. 28) of the second wall 732.

The cover member 780 is coupled to the top of the dust body 740. With the cover member 780 coupled to the top of the dust body 740, inner spaces of the dust storage 750 and the distribution unit 760 are simultaneously sealed. A dust inlet 782 is formed in the cover member 780 to allow air flowing through the dust outlet 724 to flow into the dust storage 750. A pair of air outlets 784 and 786 is formed in the cover member 780 to discharge air inside the distribution unit 760.

The distribution unit 760 separates large impurities such as tissue paper from air flowing in from the suctioning guide 715. A recessed portion 762 is formed at the bottom of the distribution unit 760. The recessed portion 762 is recessed upward from the bottom surface of the distribution unit 760. An air inlet 763 is formed in the recessed portion 762 to allow air in the suctioning guide 715 to enter.

A partition 770 is formed inside the distribution unit 760 to define a separating chamber 776 in which comparatively larger impurities are separated from air flowing in through the air inlet 763. The partition 770 is formed to have a "U"-shaped horizontal cross section. The partition 770 includes a pair of extensions 771 and 772 extending from an inner surface (or from the second wall 732) of the distribution unit 760, and a connector 775 connecting ends of the pair of extensions 771 and 772.

Figure 29:
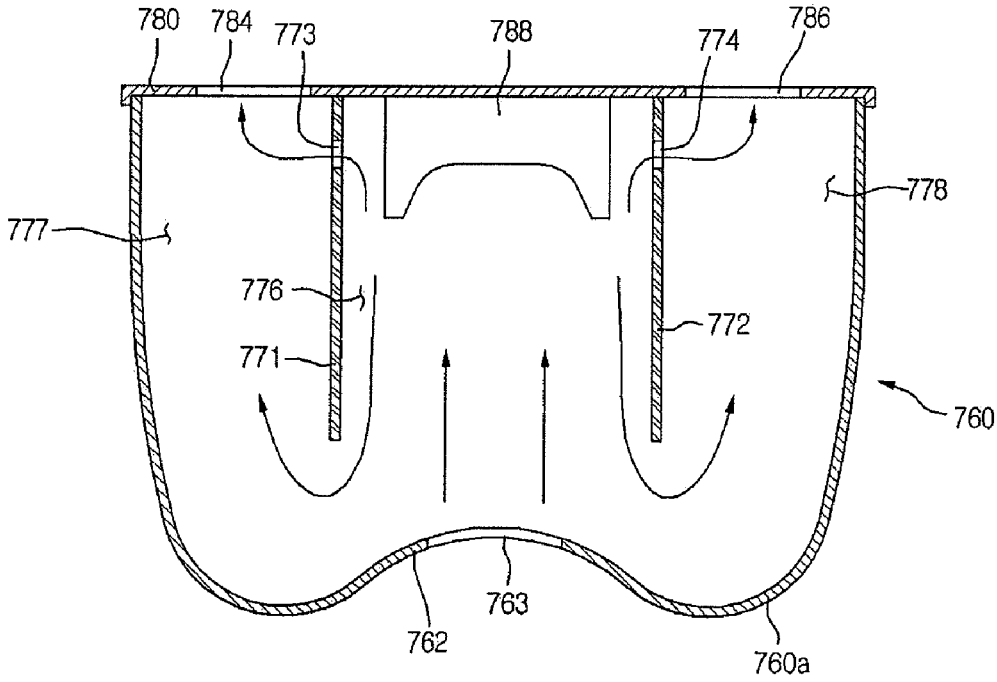
FIG. 29 is a sectional view taken along line XXIX-XXIX of FIG. 26.

As shown in FIG. 29, the connector 775 is spaced apart from the undersurface 760*a* of the distribution unit 760. The connector 775 and the pair of extensions 771 and 772 are separated from the inner periphery of the distribution unit 760, or, the first wall 731 forming the distribution unit 760. Branch passages 777 and 778 are formed, one at either side of the pair of extensions 771 and 772. Air in the respective branch passages 777 and 778 passes through the air outlets 784 and 786 and flows into the inlet 722 of the dust separating unit 710.

Through-holes 773 and 774 are formed in the extensions 771 and 772, through which a portion of air in the separating chamber 776 can be bypassed to the branch passages 777 and 778. The through-holes 773 and 774 are disposed close to the cover member 780 when the cover member 780 is coupled to the dust body 740. That is, through-holes 773 and 774 are disposed close to the air outlets 784 and 786, respectively. With the through-holes 773 and 774 thus formed in the extensions 771 and 773, a portion of air in the separating chamber 776 is bypassed to the branch passages 777 and 778, to prevent large impurities separated in the separating chamber 776 from descending, and prevent large impurities that have descended from moving to the air outlets 784 and 786.

A catch 788 is formed on the cover member 780 to catch large impurities such as tissue paper from air that enters the separating chamber 776. The catch 788 extends a predetermined distance downward from the lower surface of the cover member 780. With the cover member 780 coupled to the dust body 740, the catch 788 is disposed in the space between the pair of extensions 771 and 772.

Figure 30:
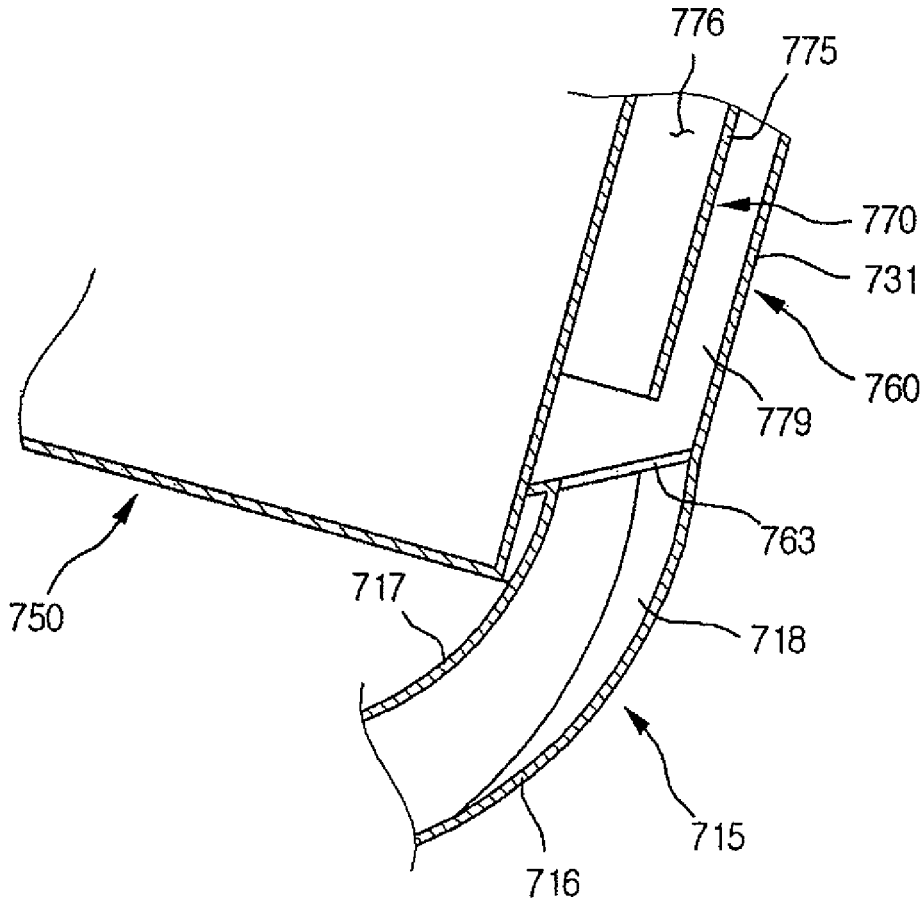
FIG. 30 is a vertical side sectional view showing a distribution unit connected to a suctioning guide according to the eighth exemplary embodiment of FIG. 25.

Referring to FIG. 30, the suctioning guide 715 is connected to the bottom of the distribution unit 760. The suctioning guide 715 is formed in a curved shape. Through the curvature of the suctioning guide, the suctioning guide 715, when viewed in a vertical cross section, includes a larger curvature portion 716 and a smaller curvature portion 717. A guide rib 718 is formed in the larger curvature portion 716 to guide the flow of lightweight impurities such as tissue paper. The guide rib 718 is formed of a predetermined length in the longitudinal direction of the suctioning guide 715. The guide rib 718 extends from the larger curvature portion toward the smaller curvature portion of the suctioning guide 715. A single guide rib 718 or multiple guide ribs may be provided.

With respect to the dust passage of the suctioning guide 715, heavier dust from dust moving through the suctioning guide 715 moves along the larger curvature portion 716 by means of inertia. The heavier dust moving through the larger curvature portion 716 passes through the inlet 763 and enters the inside of the separating chamber 776 or a space 779 between the connector 775 and the first wall 731. Conversely, lighter impurities such as tissue paper pass along the guide rib 718. The lighter impurities that move along the guide rib 718 pass through the air inlet 763 and move to the separating chamber 776. That is, the guide rib 718 guides lighter impurities such as tissue paper from impurities moving within the suctioning guide 715 to the separating chamber 776.

Having described a dust body according to an eighth exemplary embodiment above, a dust body according to a ninth exemplary embodiment will be described with reference to FIG. 31. The ninth exemplary embodiment is the same as the eighth exemplary embodiment in all other aspects except for differences in the structure of the distribution unit. Therefore, description will be provided of only the distinguishing portions of the ninth exemplary embodiment, and the description of portions that are the same as in the eighth exemplary embodiment will be omitted.

Figure 31:
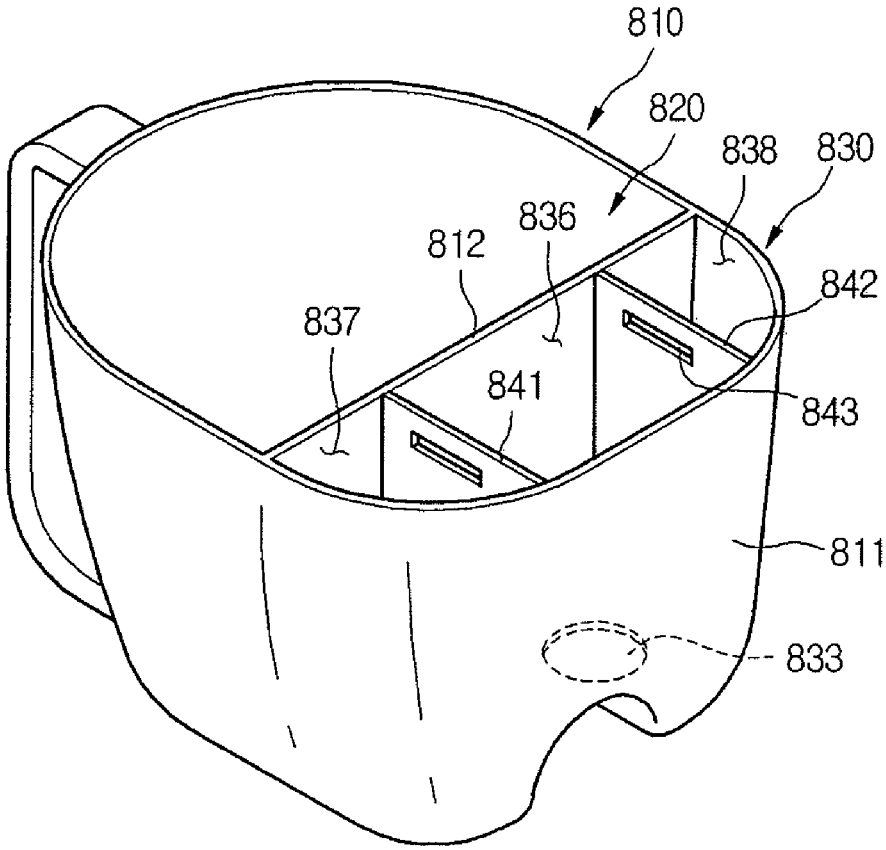
FIG. 31 is a perspective view of a dust body according to a ninth exemplary embodiment of the present invention.

Referring to FIG. 31, a dust body 810 according to the present exemplary embodiment includes a dust storage 820 and a distribution unit 830. A pair of partitions 841 and 842 is formed in the distribution unit 830 to define a separating chamber 836. The partitions 841 and 842 are separated from one another at a uniform distance. One end of each partition 841 and 842 is formed integrally with a first wall 811 defining the separating unit 830, and the other end of each partition 841 and 842 is formed integrally with a second wall 812 defining the separating unit 830. That is, the plurality of partitions 841 and 842 is formed integrally with the inner periphery of the separating unit 830. Each partition 841 and 842 has a through-hole 843 to allow air from the separating chamber 836 to be bypassed to branch passages 837 and 838. Accordingly, in the present exemplary embodiment, lighter dust moving through the suctioning guide can easily move to the separating chamber.

Having described a distribution unit according to a ninth exemplary embodiment above, a distribution unit according to a tenth exemplary embodiment will be described with reference to FIG. 32. The tenth exemplary embodiment is the same as the ninth exemplary embodiment in all other aspects except for the inclusion of a guide member formed in the structure of the distribution unit to allow dust to move to the separating chamber. Therefore, description will be provided of only the distinguishing portions of the tenth exemplary embodiment, and the description of portions that are the same as in the ninth exemplary embodiment will be omitted.

Figure 32:
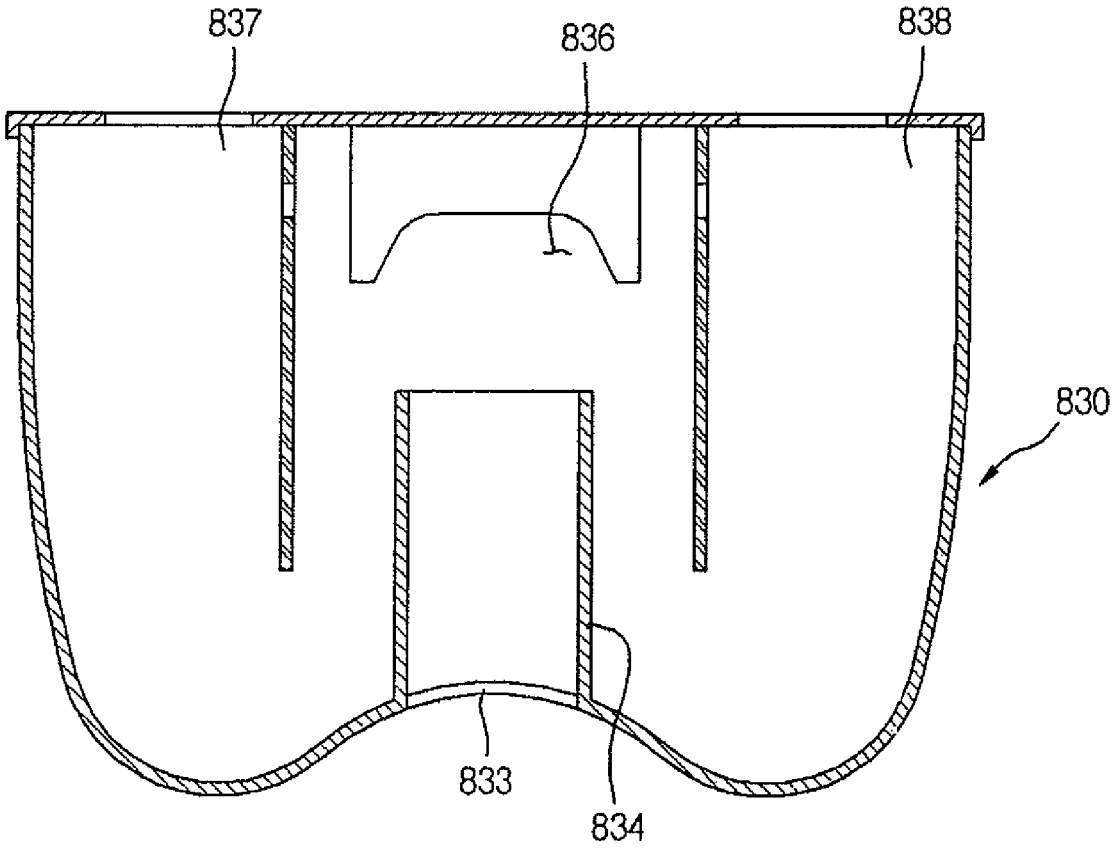
FIG. 32 is a sectional view showing the inner structure of a distribution unit according to a tenth exemplary embodiment of the present invention.

Referring to FIG. 32, a distribution unit 830 according to the tenth exemplary embodiment includes a guide member 834 formed therein to allow air suctioned into the distribution unit 830 through an air inlet 833 to flow to a separating chamber 836. The guide member 834 is provided in a tube shape and extends upward from the perimeter of the air inlet 833. A portion of the guide member 834 is disposed within the separating chamber 836. Therefore, lighter dust moving along the suctioning guide can be completely transferred to the separating chamber.

Having described a dust body according to a tenth exemplary embodiment above, a dust body according to an eleventh exemplary embodiment will be described with reference to FIG. 33. The eleventh exemplary embodiment is the same as the tenth exemplary embodiment in all other aspects except for a difference in the structure of the partition. Therefore, description will be provided of only the distinguishing portions of the eleventh exemplary embodiment, and the description of portions that are the same as in the tenth exemplary embodiment will be omitted.

Figure 33:
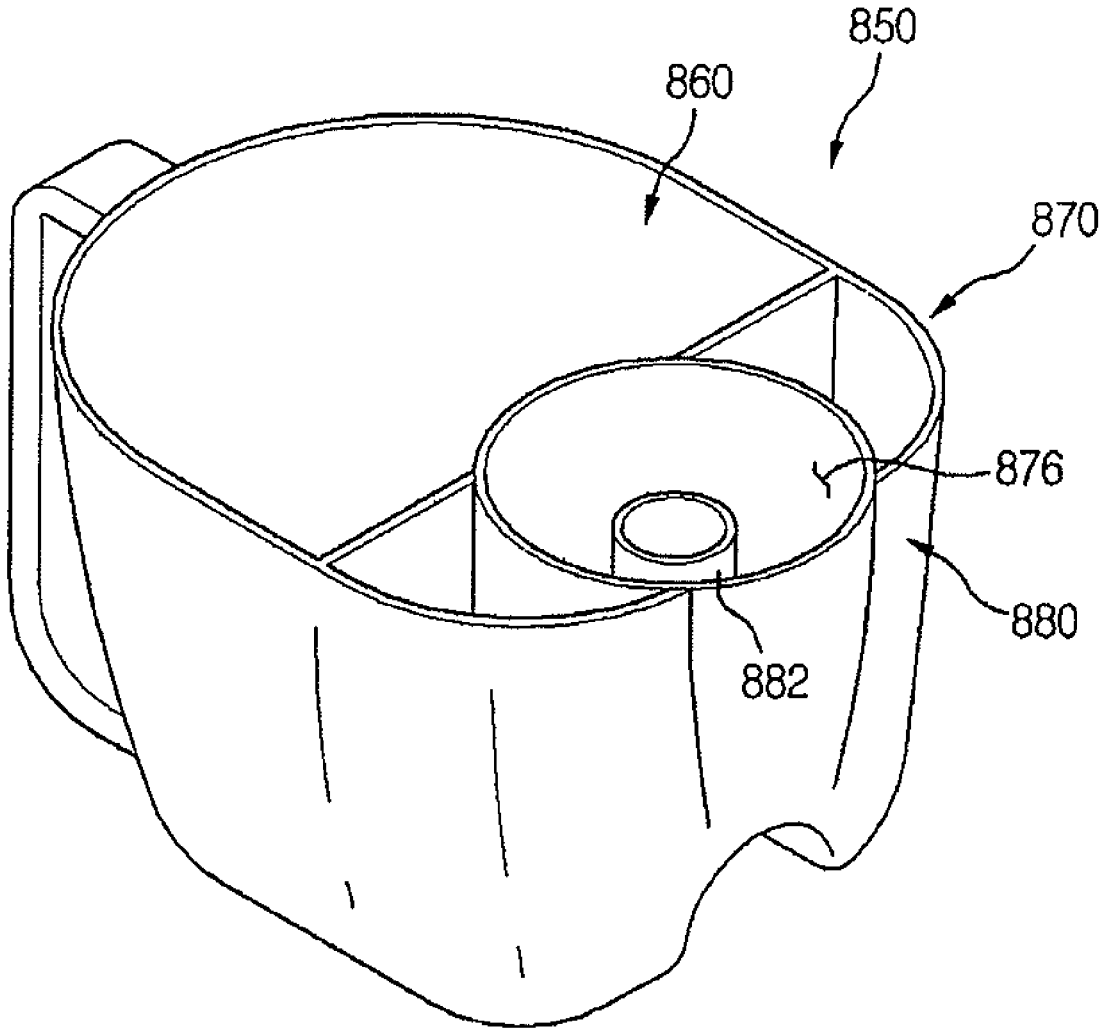
FIG. 33 is a perspective view of a dust body according to an eleventh exemplary embodiment of the present invention.

Referring to FIG. 33, a dust body 850 according to the eleventh exemplary embodiment includes a dust storage 860 and a distribution unit 870. A partition 880 for defining a separating chamber 876 is formed in the distribution unit 870. A portion of a guide member 882 extending from the perimeter of an air inlet is disposed in the partition 880. In particular, the partition 880 is formed to have a circular horizontal cross section. The diameter of the partition 880 is greater than the width of the distribution unit 870. Thus, a portion of the partition 880 protrudes to the outside of the distribution unit 870, and another portion protrudes toward the dust storage 860. Thus, the cross sectional area of the partition 880 is substantially greater than that of the guide member 882, so that the airflow velocity in the separating chamber 876 is less than the airflow velocity in the guide member 882. Accordingly, the lighter impurities such as tissue paper discharged to the separating chamber 876 remain in the separating chamber 876 and do not descend from the separating chamber 876.

Figure 34:
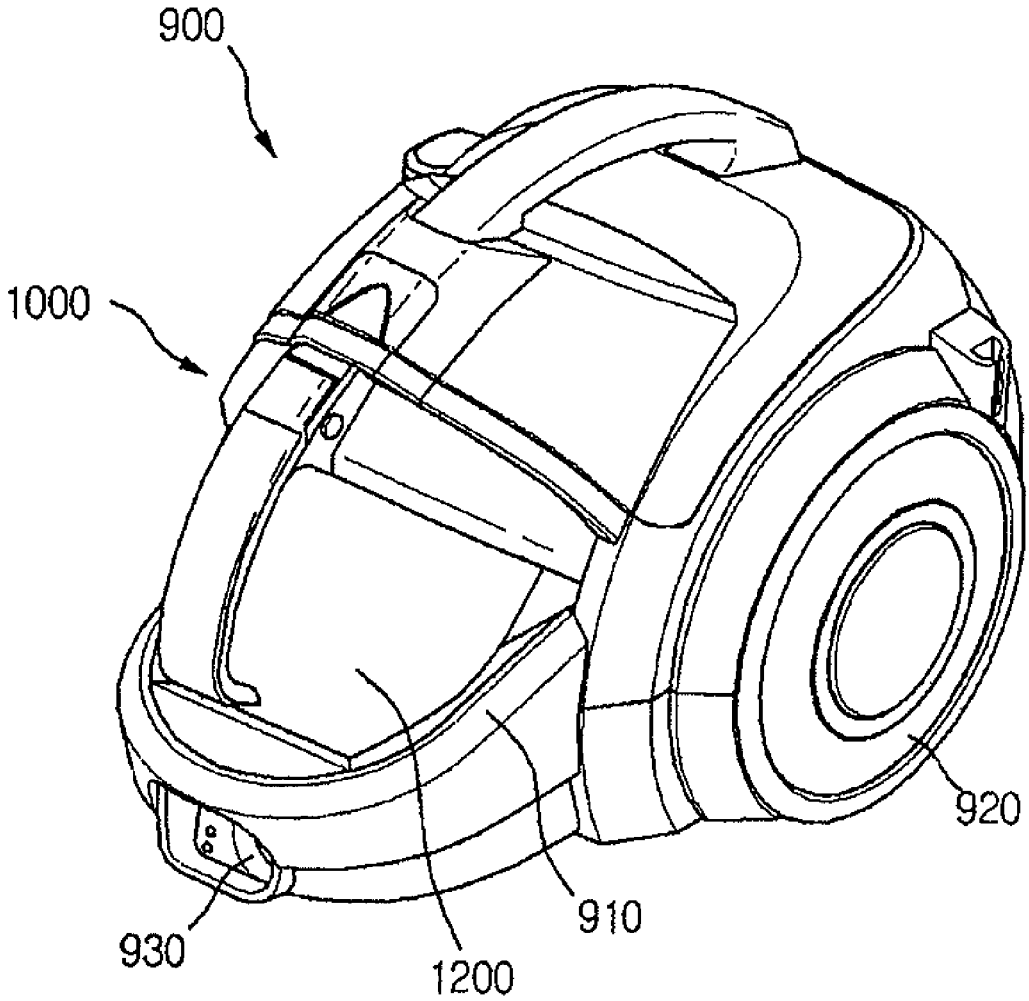
FIG. 34 is a perspective view of a vacuum cleaner having a dust separating apparatus according to a twelfth exemplary embodiment of the present invention.
Figure 35:
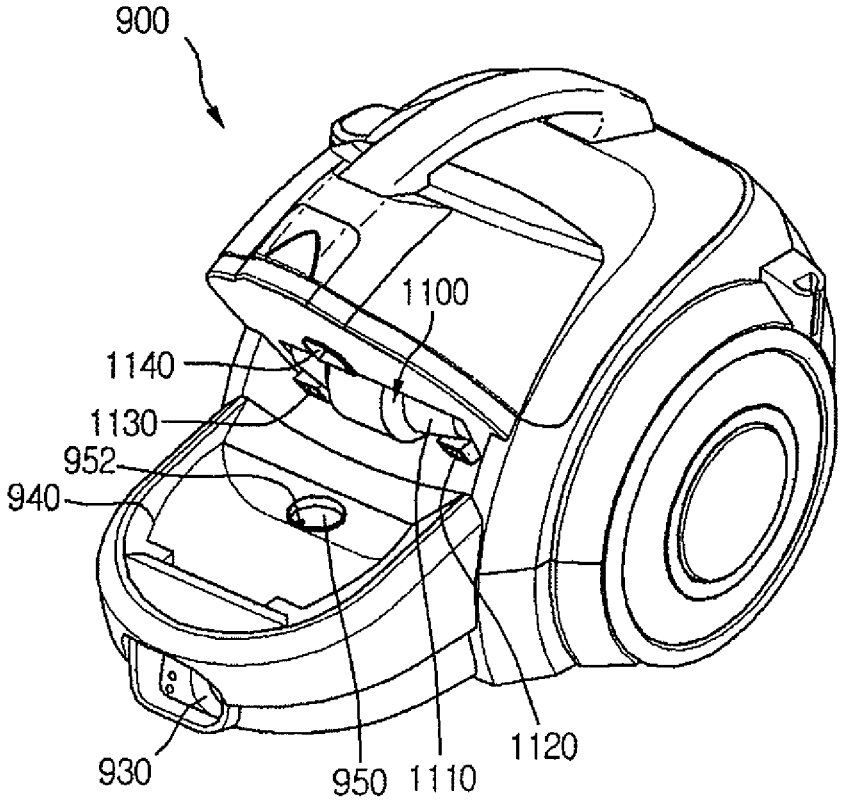
FIG. 35 is a perspective view of the vacuum cleaner of FIG. 34 with the dust container removed.

Referring to FIGS. 34 and 35, a vacuum cleaner 900 according to a twelfth exemplary embodiment includes a vacuum cleaner main body 910 and a dust separating apparatus 1000 that separates and stores dust from air suctioned into the vacuum cleaner main body 910. The vacuum cleaner main body 910 includes an air inlet 930 allowing air suctioned from a surface to be cleaned to enter the vacuum cleaner main body 910, and wheels 920 facilitating moving of the vacuum cleaner main body 910.

In particular, the dust separating apparatus 1000 includes a dust separating unit 1100 provided in the vacuum cleaner main body 910, and a dust container 1200 detachably mounted on the vacuum cleaner main body 910 to store dust separated by the dust separating unit 1100. Also, the vacuum cleaner main body 910 includes a mount 940 on which the dust container 1200 is mounted, and an outlet 950 formed in the mount 940 to allow air suctioned through the air inlet 930 into the vacuum cleaner main body 910 to be discharged to the dust container 1200. The outlet 950 includes a pressing part 952 for manipulating an opening/closing unit (to be described below) when the dust container 1200 is mounted on the mount 950.

The dust separating unit 1100 includes a cyclone 1110 that generates cyclone airflow. The cyclone 1110 has a plurality of inlets 1120 and 1130 formed therein, and includes a dust outlet 1140 at the central portion of the cyclone 1110 to discharge dust separated from air to the dust container 1200.

Figure 36:
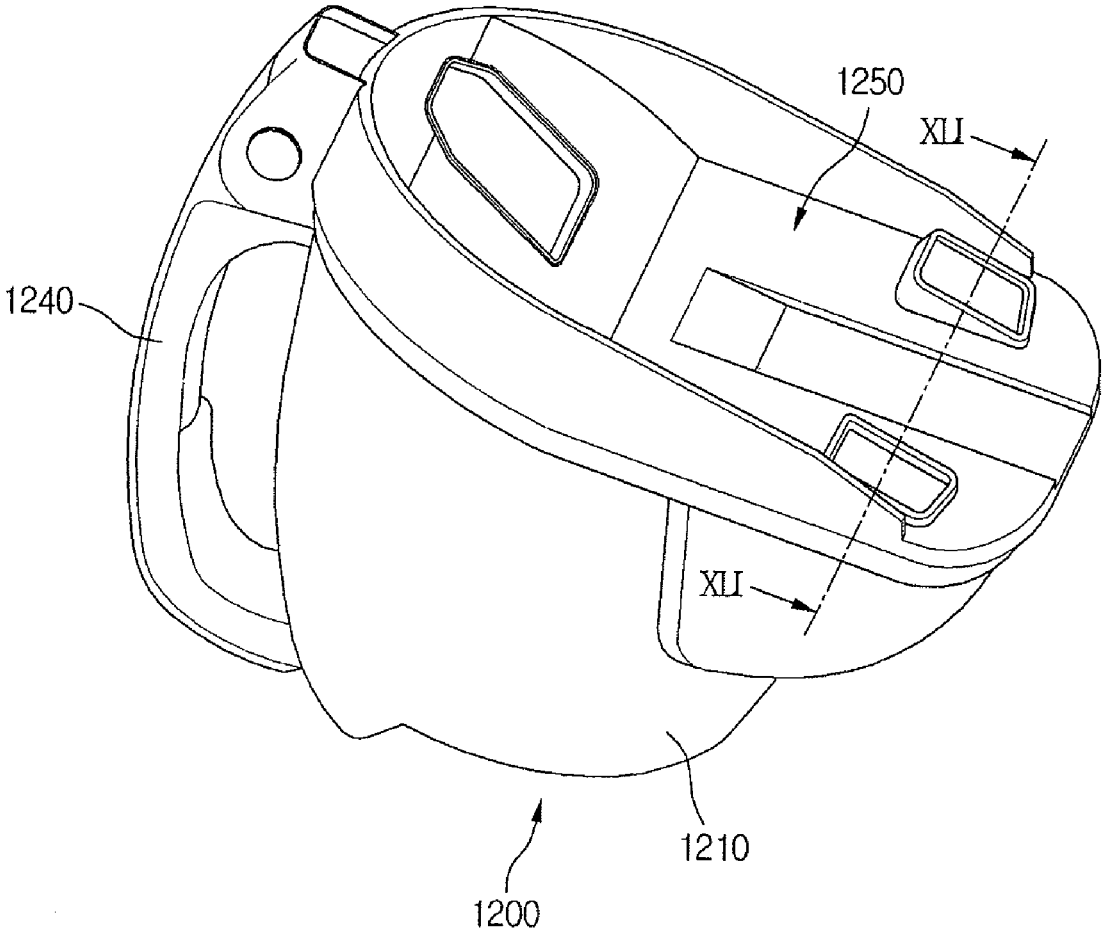
FIG. 36 is a perspective view of the dust container according to the twelfth exemplary embodiment of FIG. 34.
Figure 37:
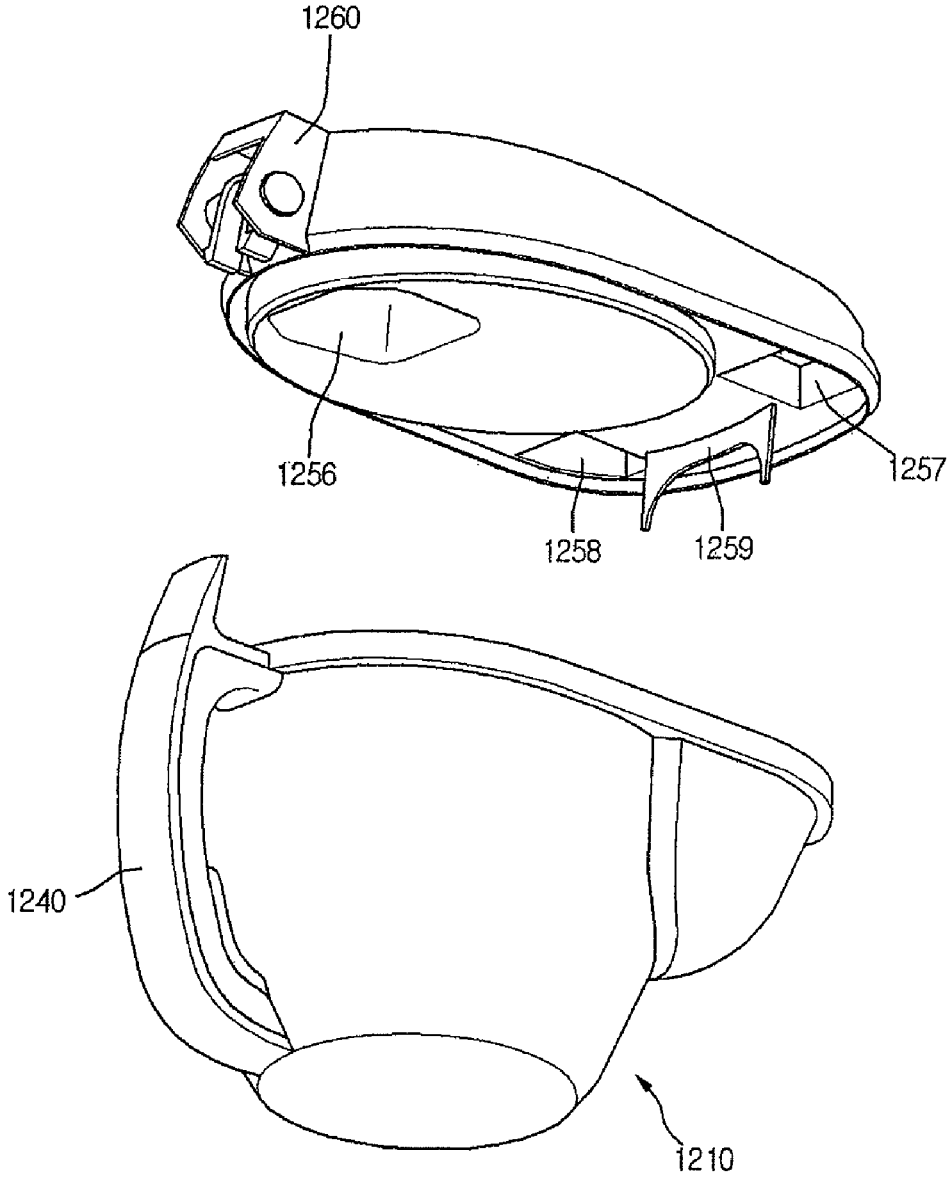
FIGS. 37 and 38 are partial perspective views of the dust container according to the twelfth exemplary embodiment of FIG. 34.
Figure 38:
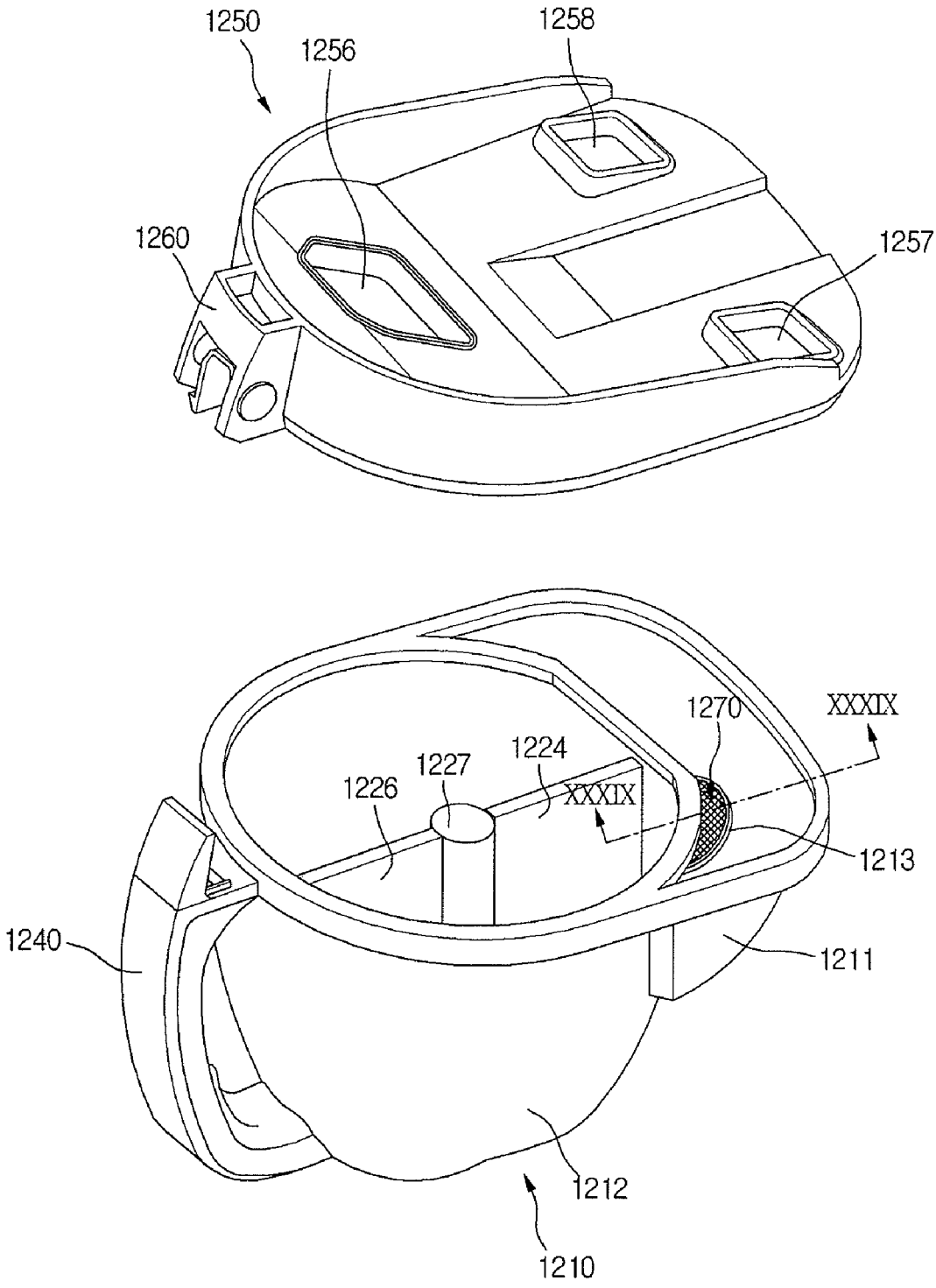

Referring to FIGS. 36 to 38, the dust container 1200 of the twelfth exemplary embodiment includes a dust body 1210 defining the exterior of the dust container 1200, a cover member 1250 for opening and closing the dust body 1210, and a handle 1240 provided at a side of the dust body 1210 to facilitate grasping of the dust body 1210. In particular, the dust body 1210 includes a first dust storage 1211 storing larger dust particles separated from air, and a second dust storage 1212 provided at a side of the first dust storage 1211 to store dust separated in the dust separating unit 1100.

A compressing device is provided within the second dust storage 1212 to compress dust stored in the second dust storage 1212. The compressing device includes a fixing member 1224 fixed to the dust body 1210, and a rotating member 1226 rotatably provided on the dust body 1210. The rotating member 1226 includes a rotating shaft 1227 rotatably coupled to the dust body 1210. The same assembly as described above in the fourth exemplary embodiment is used to rotate the rotating member 1226, and, thus, a description of the assembly will not be provided.

An air inlet 1213 is formed in the first dust storage 1211 to admit air discharged from the outlet 950. An opening/closing unit 1270 is provided at the air inlet 1213 to open and close the air inlet 1213. The opening/closing unit 1270 will be described below with reference to FIGS. 39 and 40.

Figure 39:
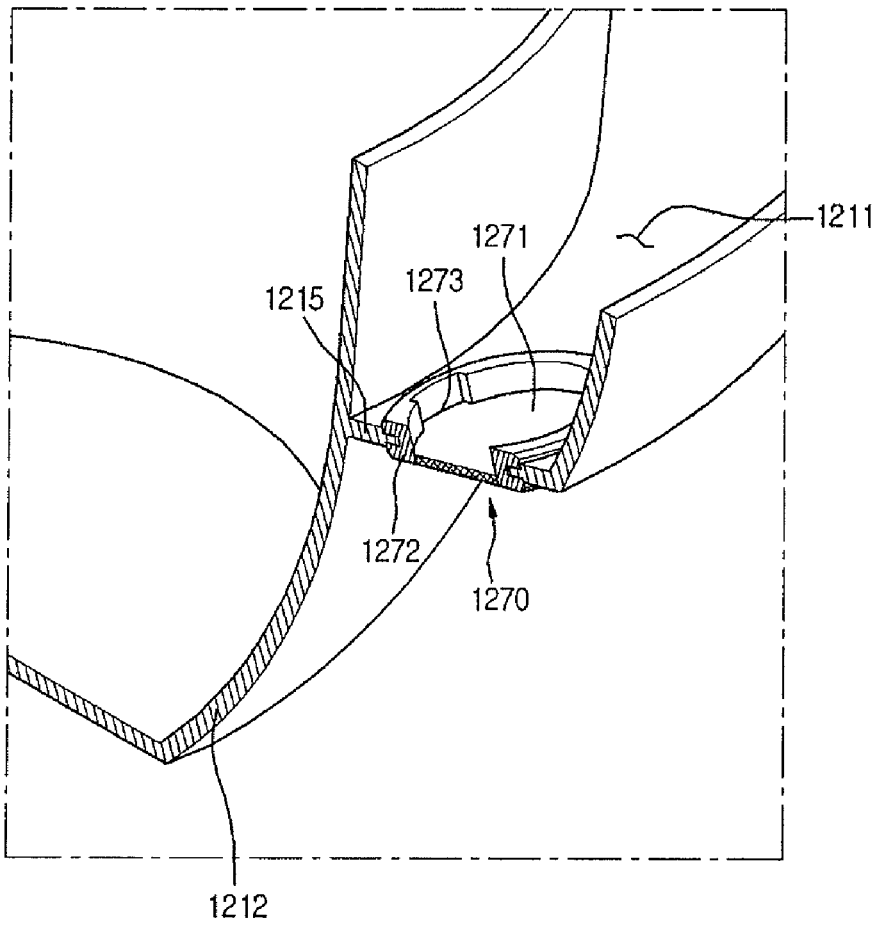
FIG. 39 is a perspective sectional view of FIG. 38 taken along line XXXIX-XXXIX.

As shown in FIGS. 38 and 39, the cover member 1250 is rotatably coupled to the dust body 1210 through a hinge 1260. The cover member 1250 includes a first outlet 1257 and a second outlet 1258 for discharging air that enters the first storage 1211 to the dust separating unit 1100. The cover member 1250 also includes a dust inlet 1256 allowing dust separated in the dust separating unit 1100 to flow into the second dust storage 1212. In this twelfth exemplary embodiment, the first dust storage 1211 and the first and second outlets 1257 and 1258 branch air that enters the dust container 1200 and distribute the air to the respective inlets 1120 and 1130. Accordingly, the first dust storage 1211 and the first and second outlets 1257 and 1258 can collectively be referred to as a distribution unit.

A dust catch 1259 is provided on the cover member 1250 to prevent larger impurities in air that enters the first dust storage 1211 from being suctioned into the air inlets 1120 and 1130.

Figure 40:
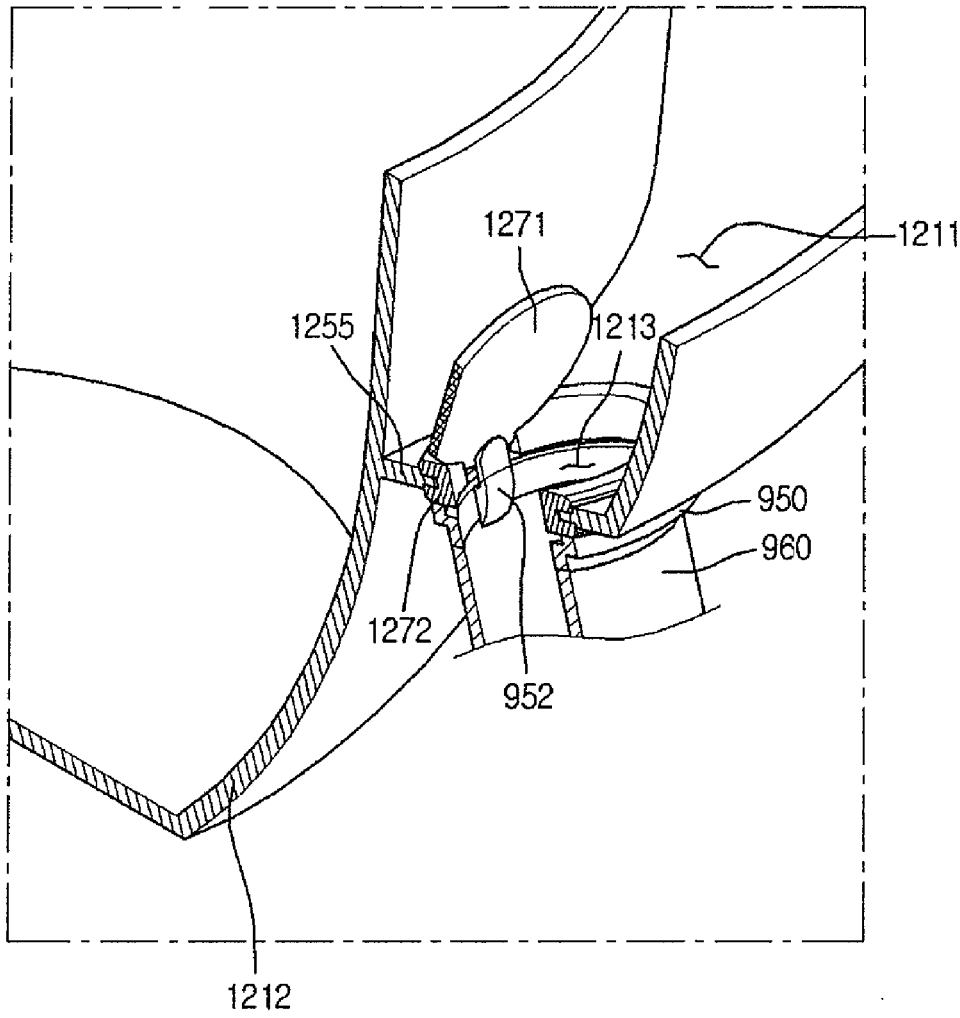
FIG. 40 is a perspective sectional view showing an opening/closing unit of FIG. 39 in a rotated state.

Referring to FIGS. 39 and 40, the first dust storage 1211 includes an opening/closing unit 1270 that opens the air inlet 1213 when the dust container 1200 is mounted on the vacuum cleaner main body 910, and closes the air inlet 1213 when the dust container 1200 is separated from the vacuum cleaner main body 910. In particular, the opening/closing unit 1270 is formed of a material having elasticity. The opening/closing unit 1270 includes a coupling member 1272 coupled to the perimeter 1215 of the air inlet 1213, an opening/closing member 1271 connected to the coupling member 1272 to open and close the air inlet 1213, and a connector 1273 connecting the coupling member 1272 and the opening/closing member 1271. The connector 1273 is formed integrally with the coupling member 1272 and the opening/closing member 1271.

The vacuum cleaner main body 910 is provided with a connecting tube 960 connecting the air inlet 1213 and the outlet 950. The outlet 950 includes the pressing part 952 formed thereon that rotates the opening/closing member 1271 when the dust container 1200 is mounted on the mount 940. Thus, as shown in FIG. 40, when the dust container 1200 is mounted on the vacuum cleaner main body 910, the pressing part 952 presses the opening/closing member 1271 upward to open the air inlet 1213 and allow airflow. Conversely, when the dust container 1200 is separated from the vacuum cleaner main body 910, the pressing force on the opening/closing member 1271 is removed to close the air inlet 1213 in order to prevent dust stored in the first dust storage 1211 from escaping to the outside of the air inlet 1213.

Figure 41:
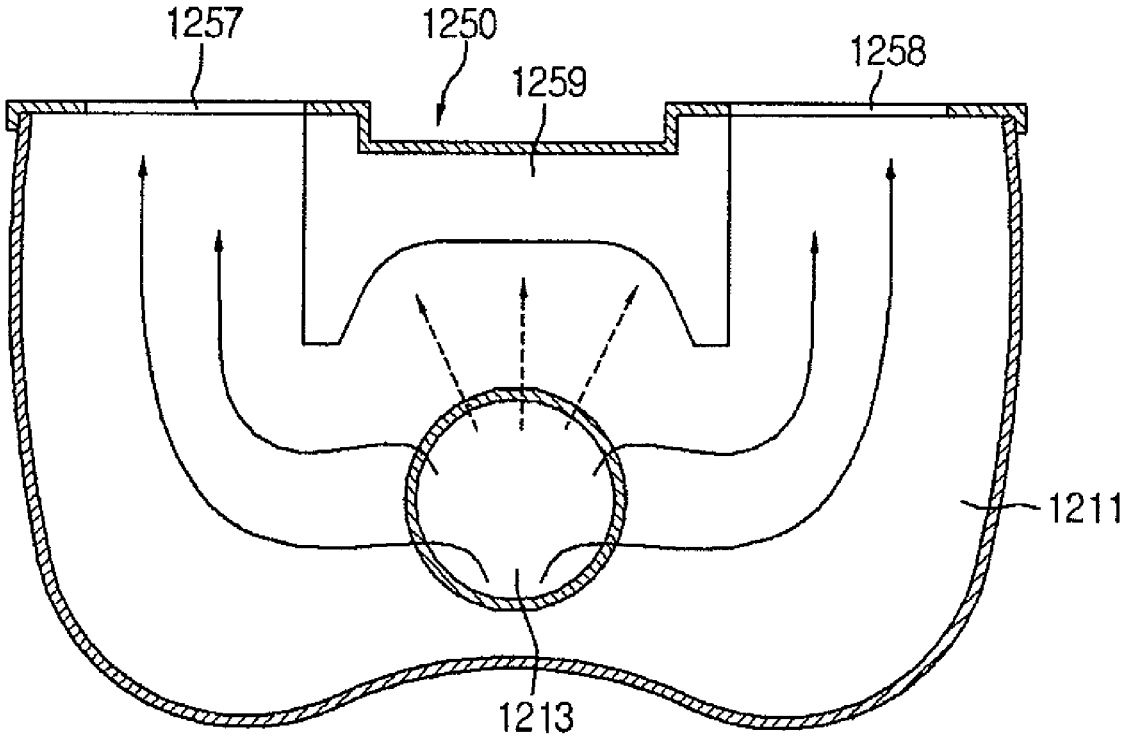
FIG. 41 is a sectional view taken along line XLI-XLI of FIG. 36.

Referring to FIG. 41, when the air inlet 1213 is opened, the air discharged from the outlet 950 enters the first dust storage 1211. The air entering the first dust storage 1211 (represented by the solid lines) branches and flows toward the plurality of outlets 1257 and 1258. In this process, larger impurities (represented by the dotted lines) are caught by the dust catcher 1259, and are prevented from passing through the outlets 1257 and 1258 and remain in the first dust storage 1211.

Having described a cover member for a dust container according to a twelfth exemplary embodiment above, a dust body according to a thirteenth exemplary embodiment will be described with reference to FIG. 42. The thirteenth exemplary embodiment is the same as the twelfth exemplary embodiment in all other aspects except for a difference in the structure of the cover member. Therefore, description will be provided of only the distinguishing portions of the thirteenth exemplary embodiment, and the description of portions that are the same as in the twelfth exemplary embodiment will be omitted.

Figure 42:
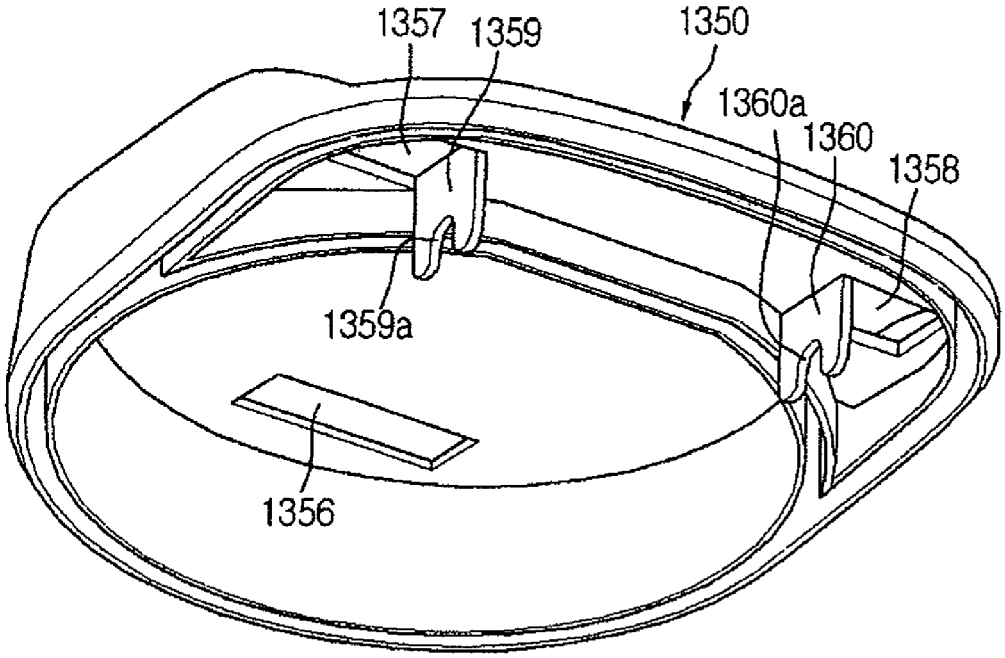
FIG. 42 is a perspective view of a cover member for a dust container according to a thirteenth exemplary embodiment of the present invention.

Referring to FIG. 42, a cover member 1350 according to the present exemplary embodiment includes a first outlet 1357 and a second outlet 1358 that discharge air that enters the first dust storage 1211 to the dust separating unit 1100. Also, the cover member 1350 includes a dust inlet 1356 admitting dust separated in the dust separating unit 1100 into the second dust storage 1212. Additionally, a plurality of dust catches 1359 and 1360 is provided at the bottom of the cover member 1350 to prevent large impurities in air entering the first dust storage 1211 from being suctioned into the air inlets 1120 and 1130 of the dust separating unit 1100.

The plurality of dust catches 1359 and 1360 includes a first catch 1359 and a second catch 1360. In particular, the dust catches 1359 and 1360 are provided proximate to the outlets

1357 and 1358, respectively. Thus, large impurities, such as tissue paper, are caught on the respective catches 1359 and 1360 and are prevented from passing through the outlets 1357 and 1358. Flow recesses 1359*a* and 1360*a* are formed in the catches 1359 and 1360, respectively, to allow smaller dust particles to pass through. Therefore, larger impurities in air flowing through the air inlet 1213 are stored in the first dust storage by means of the plurality of catches 1359 and 1360, and smaller dust particles are discharged through the outlets 1357 and 1358.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dust separating apparatus for a vacuum cleaner, the dust separating apparatus comprising:

a cyclone configured to provide a plurality of cyclone airflows therein, the cyclone including:

a first air inlet configured to receive an airflow containing dust;

a second air inlet configured to receive an airflow containing dust, the second air inlet spaced apart from the first air inlet; and a dust outlet configured to discharge dust separated by the plurality of cyclone airflows, the dust outlet being located between the first air inlet and the second air inlet; and a dust container provided separate from the cyclone, the dust container being removably placeable into communication with the dust outlet to collect dust separated in the cyclone, wherein each of the cyclone airflows moves in a mutually convergent direction.

2. The dust separating apparatus of claim 1, wherein the dust container has an upper surface and a dust inlet in the upper surface, the dust inlet being arranged opposite the dust outlet of the cyclone when placed into communication with the dust outlet.

3. The dust separating apparatus of claim 1, wherein the cyclone include a body in which air flows along an inner surface thereof, the body having a pair of spaced apart ends defining side surfaces of the cyclone, and the dust outlet extends outward from the body.

4. The dust separating apparatus of claim 1, wherein the dust container comprises a dust body defining a dust storage, and a cover member for opening and closing the dust storage, the cover member including a dust inlet formed therein for the dust separated in the cyclone to enter therethrough.

5. The dust separating apparatus of claim 1, further comprising an air return passage configured to return air that enters the dust container to the dust separating unit.

6. The dust separating apparatus of claim 5, wherein the dust separating unit includes a passage guide to divide the dust outlet into a dust outlet passage and an air return passage.

7. The dust separating apparatus of claim 1, wherein the dust container defines a dust storage, the dust container includes a partition in the dust storage, and the dust container includes a compressing member configured to compress dust in the dust storage by pressing the dust between the compression member and the partition.

8. The dust separating apparatus of claim 7, wherein the compressing member includes a rotatable shaft and a compressing plate extending from the rotatable shaft.

9. The dust separating apparatus of claim 8, wherein the compression member includes a second compressing plate extending from the rotatable shaft.

10. The dust separating apparatus of claim 8, wherein the dust container includes a fixing shaft located in the dust storage to rotatably support the rotatable shaft.

11. The dust separating apparatus of claim 10, wherein the rotatable shaft includes a first end received in the fixing shaft.

12. The dust separating apparatus of claim 11, wherein the dust container includes a driven gear connected to the first end of the rotatable shaft, and the driven gear is located at an exterior surface of the dust container.

13. The dust separating apparatus of claim 1, further comprising a distribution unit configured to distribute airflow containing dust to the first air inlet and the second air inlet.

14. A vacuum cleaner comprising:

a vacuum cleaner main body;

a cyclone located in the vacuum cleaner main body, the cyclone being configured to provide a plurality of cyclone airflows therein, the cyclone including:

a first air inlet configured to receive an airflow containing dust;

a second air inlet configured to receive an airflow containing dust; and a dust outlet configured to discharge dust separated by the plurality of cyclone airflows, the dust outlet being located in a central portion of the cyclone;

a dust container provided separate from the cyclone, the dust container being removably placeable into communication with the dust outlet to collect dust separated in the cyclone; and a distribution unit configured to separate airflow into the vacuum cleaner into two separate passages, each passage being in communication with one of the first and second air inlets.

15. The vacuum cleaner of claim 14, wherein the dust container has an upper surface and a dust inlet in the upper surface, the dust inlet being arranged opposite the dust outlet of the cyclone when placed into communication with the dust outlet.

16. The vacuum cleaner of claim 14, wherein the cyclone include a body in which air flows along an inner surface thereof, the body having a pair of spaced apart end defining side surfaces of the cyclone, and the dust outlet extends outward from the body.

17. The vacuum cleaner of claim 14, wherein the dust container comprises:

a dust body defining a dust storage, and a cover member for opening and closing the dust storage, the cover member including a dust inlet formed therein for the dust separated in the cyclone to enter therethrough.

18. The vacuum cleaner according to claim 14, wherein the distribution unit is integrally formed with the dust container.

19. The vacuum cleaner according to claim 18, wherein the distribution unit includes one air inlet and a pair of air outlets.

20. The vacuum cleaner according to claim 14, wherein the dust container includes a first space and a second space separated by a partition, the air discharged from the first space enters the distribution unit, and the second space stores dust separated in cyclone.

* * * * *